US006335693B1

(12) United States Patent
Takahashi et al.

(10) Patent No.: US 6,335,693 B1
(45) **Date of Patent: *Jan. 1, 2002**

(54) INFORMATION EXCHANGE SYSTEM

(75) Inventors: Kazunori Takahashi; Yoshihito Sato; Takeshi Shima, all of Hitachi; Hiroshi Shojima, Hitachiota; Takayuki Iino, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,483

(22) Filed: Jun. 19, 2000

Related U.S. Application Data

(63) Continuation of application No. 09/201,957, filed on Dec. 1, 1998, now Pat. No. 6,097,313.

(30) Foreign Application Priority Data

Dec. 4, 1997 (JP) ..... 9-334329

(51) Int. Cl.[7] ..... G08B 1/09
(52) U.S. Cl. ..... 340/905; 340/991; 340/993
(58) Field of Search ..... 340/905, 901, 340/907, 916, 991, 993, 995

(56) References Cited

U.S. PATENT DOCUMENTS 5,133,081 A * 7/1992 Mayo ..... 455/18
5,247,439 A * 9/1993 Gurmu et al. ..... 364/424.02
5,289,183 A * 2/1994 Hassett et al. ..... 340/905
5,504,683 A * 4/1996 Gurmu et al. ..... 364/436
5,579,535 A * 11/1996 Orlen et al. ..... 455/33.1
5,877,708 A * 3/1999 Hijikata ..... 340/995
5,900,825 A * 5/1999 Pressel et al. ..... 340/905

FOREIGN PATENT DOCUMENTS

| | | |
|---|---|---|
| JP | 6-295397 | 10/1994 |
| JP | 7-129895 | 5/1995 |
| JP | 9-222335 | 8/1997 |

* cited by examiner

*Primary Examiner*—Daniel J. Wu
*Assistant Examiner*—Toan Pham
(74) *Attorney, Agent, or Firm*—Kenyon & Kenyon

(57) ABSTRACT

An information exchange system is capable of realizing useful information exchange both for the service provider located along the road and providing services and the vehicular driver, by effectively using limited communication capacity of the road-vehicle radio communication. The information exchange system has a vehicle-mounted unit and a road-side unit providing information to the vehicle-mounted unit using a road-vehicle radio communication. The vehicle-mounted unit includes receiving unit receiving information transmitted from the road-side unit through a radio communication and transferring unit transferring at least a part of a content of the received information to a vehicular occupant. The road-side unit including storage unit storing information to be transmitted to the vehicle-mounted unit and transmitting unit transmitting information to the vehicle-mounted unit through the radio communication. The storage means stores at least information relating to a service provider where a service is provided at the location thereof. The road-side unit also includes editing unit editing information stored in the storage means on the basis of a relative position between the service provider and a communication region of the transmitting means and generating an edited information to be transmitted from the transmitting means.

15 Claims, 18 Drawing Sheets

FIG.4

ROAD SIDE→VEHICLE

0401

| VEHICULAR ONBOARD UNIT ID1 | INFORMATION KIND 11 | DETAIL DEGREE 11 | INFORMATION CONTENT 11 | INFORMATION KIND 12 | DETAIL DEGREE 12 | INFORMATION CONTENT 12 | .. |
|---|---|---|---|---|---|---|---|
| VEHICULAR ONBOARD UNIT ID2 | INFORMATION KIND 21 | DETAIL DEGREE 21 | INFORMATION CONTENT 21 | INFORMATION KIND 22 | DETAIL DEGREE 22 | INFORMATION CONTENT 22 | .. |
| VEHICULAR ONBOARD UNIT ID3 | INFORMATION KIND 31 | DETAIL DEGREE 31 | INFORMATION CONTENT 31 | INFORMATION KIND 32 | DETAIL DEGREE 32 | INFORMATION CONTENT 32 | .. |
| .... | .... | .... | .... | .... | .... | .... | .. |

VEHICLE→ROAD SIDE

0402

| VEHICULAR ONBOARD UNIT | INFORMATION KIND 1 | DETAIL DEGREE 1 | INFORMATION KIND 2 | DETAIL DEGREE 2 | .. |
|---|---|---|---|---|---|

n=1～N(NOS.OF INTER ROAD & VEHICLE COMM.UNITS)

INFORMATION EXCHANGE SYSTEM

This is a continuation of U.S. patent application Ser. No. 09/201,957, filed Dec. 1, 1998 U.S. Pat. No. 6,097,313.

BACKGROUND OF THE INVENTION

1. Field of the Invention

The present invention relates to an information exchange system for exchanging information between a road-side communication unit and a vehicle-mounted communication unit in a traffic information system.

2. Description of the Related Art

As an information exchanging technology for exchanging information between a radio communication equipment mounted on a traveling vehicle and a radio communication equipment having narrow communication region on the road, which later radio communication equipment is installed on the road-side, there have been methods to realize bidirectional communication between the road-side radio communication equipment which will be occasionally referred to as "road-side unit", and the vehicle-mounted radio communication equipment which will by occasionally referred to as "vehicle-mounted unit", by providing a vehicle detector disclosed in Japanese Unexamined Patent Publication No. Heisei 6-96387, optical receiver for a high speed data transmission disclosed in Japanese Unexamined Patent Publication No. Heisei 6-276157, TDMA network protocol structure for reader-transponder communication disclosed in Japanese Unexamined Patent Publication No. Heisei 6-61937.

In Japan, it has been started an information service

In Japan, it has been started an information service called VICS (Vehicle Information and Communication System) for mainly transmitting a traffic related information from the road-side unit to the vehicle-mounted unit. In VICS, a narrow region radio communication, a radio wave beacon system and an optical beacon system are employed and a wide region radio communication, an FM multiplex system is employed.

As a vehicle-mounted unit adapted for VICS, various types of equipment, such as a VICS receiver unit disclosed in Japanese Unexamined Patent Publication No. Heisei 9-133535, for example, have been put into practice. Regularly updated traffic related information, such as traffic-jam information, travel information, accident information, construction information and so forth, is transmitted to the vehicle. Amongst, the optical beacon system utilizes the vehicle detector disclosed in Japanese Unexamined Patent Publication No. Heisei 6-96387 and includes information communication function from the vehicle-mounted unit to the road-side unit. Currently, studies have been in progress to transmit destination information and travel time information of the vehicle from the vehicle-mounted unit to the road-side unit.

By using a narrow region road-vehicle communication, such as the VICS, the traffic related information can be transmitted to the vehicle. However, in the currently available service, the information to be transmitted to the vehicle is limited to the traffic related information. It has been considered that a system for improving convenience of a vehicular driver by transmitting a service information of service providers along the traveling road, such as restaurant, gasoline station, shop, in addition to or in place of the traffic related information.

However, in the narrow region road-vehicle communication, since a period, in which the vehicle passes the communication region, is limited, an amount of information to be transmitted to the vehicle is limited. Therefore, it becomes necessary to certain selection of service information to be provided in order to establish a system which can provide practically useful service information.

In the conventional system providing the traffic related information, in consideration of a certain range around the beacon, traffic information relating to roads within that range is picked up and transmitted to the vehicle. A selection range is varied depending upon kind of the road in such a manner that traffic information of greater distance for the road of greater importance. As set forth above, a viewpoint from the road is dominant for the traffic information. Therefore, the information to be provided is uniform for all of vehicles mounting the radio communication units.

On the other hand, concerning the information of the service providers along the road, amount of information becomes greater for providing information of content of services more accurately. On the other hand, while the traffic information is the information commonly required for all drivers of the vehicles, content of service information to be desired or required for each individual driver is different. Therefore, if manner of selection of information as being conventionally taken in the traffic information is used as is, it is possible that the information desired or required by the driver cannot be provided appropriately.

SUMMARY OF THE INVENTION

The present invention has been worked out in view of the problems set forth above. Therefore, it is an object of the present invention to provide information exchange system which permits a service provider to transmit information concerning a service content to a traveling vehicle.

Another object of the present invention is to provide an information exchange system which can transmit a service information edited depending upon a demanded condition set by a user on a vehicle side, in order to effectively use a communication capacity.

A further object of the present invention is to provide an information exchange system which can vary detail degree or preference of information to be provided depending upon a positional relationship between the service provider and the vehicle.

A still further object of the present invention is to provide an information exchange method realizing a road-side unit or a vehicle-mounted unit constituting the information exchange system, or said information exchange system per se, which can achieve at least one of the foregoing objects.

According to one aspect of the present invention, an information exchange system comprises:

a vehicle-mounted unit mounted on a vehicle;

a road-side unit providing information to the vehicle-mounted unit using a road-vehicle radio communication;

the vehicle-mounted unit including receiving means for receiving information transmitted from the road-side unit through a radio communication and transferring means for transferring at least a part of a content of the received information to a vehicular occupant;

the road-side unit including storage means for storing information to be transmitted to the vehicle-mounted unit and transmitting means for transmitting information to the vehicle-mounted unit through the radio communication;

the storage means of the road-side unit for storing at least information relating to a service provider where a service is provided at the location thereof; and the road-side unit further including editing means for editing information stored in the storage means on the basis of a relative position between the service provider and a communication region of the transmitting means and generating an edited information to be transmitted from the transmitting means.

In the preferred construction, the vehicle-mounted unit may further include setting means for permitting the vehicular occupant to set information and second transmitting means for transmitting the set information to the road-side unit through the radio communication;

the road-side unit may further include second receiving means for receiving information transmitted from the vehicle-mounted unit through the radio communication and parsing means for paring the received information; and the editing means of the road-side unit may perform editing process by using at least one of the relative position and a result of parsing by the parsing means.

The information relating to the service provider stored the storage means of the road-side unit may be a plurality of information obtained with respect to a particular service provider, which the plurality of information can be edited by the editing process of the editing means.

The storage means of the road-side unit may store at least information relating to a plurality of service providers and kind information for respectively specifying kind of the plurality of service providers or information thereof;

the vehicle-mounted unit may further include kind setting means for setting kind of the service providers and information thereto to be transmitted to the vehicular occupant in response to external operation, and selecting means for selecting information transmitted from the road-side unit using the kind information and set kind information; and the transferring means of the vehicle-mounted unit may transfer the selected information to the vehicular occupant.

The storage means of the road-side unit may store at least information relating to a plurality of service providers and kind information for respectively specifying kind of the plurality of service providers or information thereof;

the vehicle-mounted unit may further include kind setting means for setting kind of the service providers and information thereto to be transmitted to the vehicular occupant in response to external operation, and selecting means for selecting information transmitted from the road-side unit using the kind information and set kind information;

the transferring means of the vehicle-mounted unit may transfer the selected information to the vehicular occupant;

the second transmitting means of the vehicle-mounted unit may transmit information relating to the set kind to the road-side unit; and the editing means of the road-side unit may perform editing process using the information relating to kind when the information relating to kind is included in information transmitted from the vehicle-mounted unit, for generating information to be transmitted to the vehicle-mounted unit.

The storage means of the road-side unit may store at least a plurality of information of different detail degrees with respect to one service provider and detail degree information for specifying respective of a plurality of information of different detail degrees;

the vehicle-mounted unit may further include detail degree setting means for setting information of detail degree to be transferred to the vehicular occupant in response to external operation and selecting means for selecting information transmitted from the road-side unit using the detail degree information and set detail degree when the detail degree information is increased in information provided from the road-side unit; and the transferring means of the vehicle-mounted unit may transfer the selected information to the vehicular occupant.

The storage means of the road-side unit may store at least a plurality of information of different detail degrees with respect to one service provider and detail degree information for specifying respective of a plurality of information of different detail degrees;

the vehicle-mounted unit may further include detail degree setting means for setting information of detail degree to be transferred to the vehicular occupant in response to external operation and selecting means for selecting information transmitted from the road-side unit using the detail degree information and set detail degree when the detail degree information is increased in information provided from the road-side unit;

the transferring means of the vehicle-mounted unit may transfer the selected information to the vehicular occupant;

the second transmitting means of the vehicle-mounted unit may transmit information relating to set detail degree to the road-side unit; and the editing means of the road-side unit may perform editing process using the information relating to detail degree when the information relating to detail degree is contained in information transmitted from the vehicle-mounted unit.

The storage means of the road-side unit may further store information relating to a plurality of service providers and information relating to contact points for radio communication with each of the service providers;

the vehicle-mounted unit may further include service provider selecting means for selecting a particular service provider among a plurality of service providers indicated in the transmitted information when the information relating to contact points is included in information transmitted from the road-side unit, and second radio communication means for performing radio communication with the selected service provider using the information relating to the contact point.

The storage means of the road-side unit may store information relating to a plurality of service providers and information relative to relative positions between each service provider and the transmitting means; and the vehicle-mounted unit may further include re-sorting means for controlling operation of the transferring means for varving mode of transferring of information relating to a plurality of service providers transmitted from the road-side unit for reflecting the relative positions when information relating to relative position is included in information transmitted from the road-side unit.

Information set by the setting means of the vehicle-mounted unit may include information relating to a kind of vehicle;

the storage means of the road-side unit may store information relating to the service provider with correspondence to a vehicular kind, to which information is to be provided preferentially; and the editing means may edit information stored in the storage means using information relating to vehicular kind transmitted from the vehicle-mounted unit and generates information directed to the vehicle which is the source of the information relating to the vehicular kind.

Information set by the setting means of the vehicle-mounted unit may include information indicative of a destination of the vehicle;

the storage means of the road-side unit may store information relating to the service provider with correspondence to a destination, to which information is to be provided preferentially; and the editing means may edit information stored in the storage means using information relating to destination transmitted from the vehicle-mounted unit and generates information directed to the vehicle which is the source of the information relating to the destination.

The vehicle-mounted unit may further include second storage means storing information, storing means for selectively storing information transmitted from the road-side unit in the second storage means, and deleting means for selectively deleting information stored in the second storage means.

The road-side unit may further include detecting means for detecting vehicular information relating to a traveling condition of the vehicle passing, the detecting means being installed corresponding to position of the communication region of the transmitting means; and the editing means may perform editing process using the detected vehicular information for generating information to be transmitted from the transmitting means.

The road-side unit may further include detecting means for detecting information indicative of illuminating condition of a traffic light set at a position corresponding to the communication region of the transmitting means; and the editing means may perform editing process using the detected information for generating information to be transmitted from the transmitting means.

The road-side unit may further includes managing means for managing information indicative of a time stored in the storage means;

the storage means may store information relating to the service provider and a time, at which the information becomes effective; and the editing means may perform editing process using the information of time recognized that the information becomes effective by the managing means, for generating information to be transmitted from the transmitting means.

The vehicle-mounted unit may further include detecting means for detecting a conditional amount of the vehicle which mounts the vehicle-mounted unit; and the setting means may vary information to be set depending upon the detected conditional amount.

The road-side unit may transmit a plurality of information relating to the service provider and information indicative of effective range in time or region, to the vehicle-mounted unit; and the vehicle-mounted unit may include means for making judgment for each of information transmitted whether it falls within the effective range in time or in region, or not, for deleting information judged as being out of the effective range.

The detecting means of the road-side unit may detect an average speed of the vehicle passing; and the transmitting means may vary a communication capacity of radio communication to be used depending upon the average speed.

According to another aspect of the present invention, a road-side unit comprises:

storage means for storing information to be transmitted to a vehicle through a road-vehicle radio communication;

transmitting means for transmitting information to the vehicle;

the storage means storing at least information relating to a service provider where a service is provided at the location thereof; and editing means for editing information stored in the storage means on the basis of a relative position between the service provider and a communication region of the transmitting means and generating an edited information to be transmitted from the transmitting means.

According to a further aspect of the present invention, a vehicle-mounted unit comprises:

receiving means for receiving information transmitted from a road-side unit through a radio communication;

transferring means for transferring at least a part of a content of the received information to a vehicular occupant;

the receiving means receiving a plurality of different information relating to at least one of a plurality of service providers where services are provided at locates thereof; and selecting means for receiving an operation for selecting information to be transferred to the vehicular occupant among a plurality of information received.

According to a still further aspect of the present invention, a moving body passing through a communication region capable of road-vehicle radio communication and being controlled moving operation by a driver, and mounting a vehicle-mounted unit comprising:

receiving means for receiving information transmitted from a road-side unit through a radio communication;

transferring means for transferring at least a part of a content of the received information to a vehicular occupant;

the receiving means receiving a plurality of different information relating to at least one of a plurality of service providers where services are provided at locates thereof; and selecting means for receiving an operation for selecting information to be transferred to the vehicular occupant among a plurality of information received.

According to a yet further aspect of the present invention, a method for exchanging information for providing information from a side of road to a vehicle using a road-vehicle radio communication, comprises:

editing information relating to a service provider where a service is provided at a location thereof on the basis of a relative relationship between the service provider and a region where the road-vehicle radio communication is possible, and generating a transmission information to be transmitted; and transmitting the transmission information to the vehicle passing through the region where road-vehicle radio communication is possible.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings:

FIG. 4 is an explanatory illustration showing an example of a structure of information content of a road-vehicle radio communication in the embodiment of the information exchange system of FIG. 3;

DESCRIPTION OF THE PREFERRED EMBODIMENT

Figure 1:
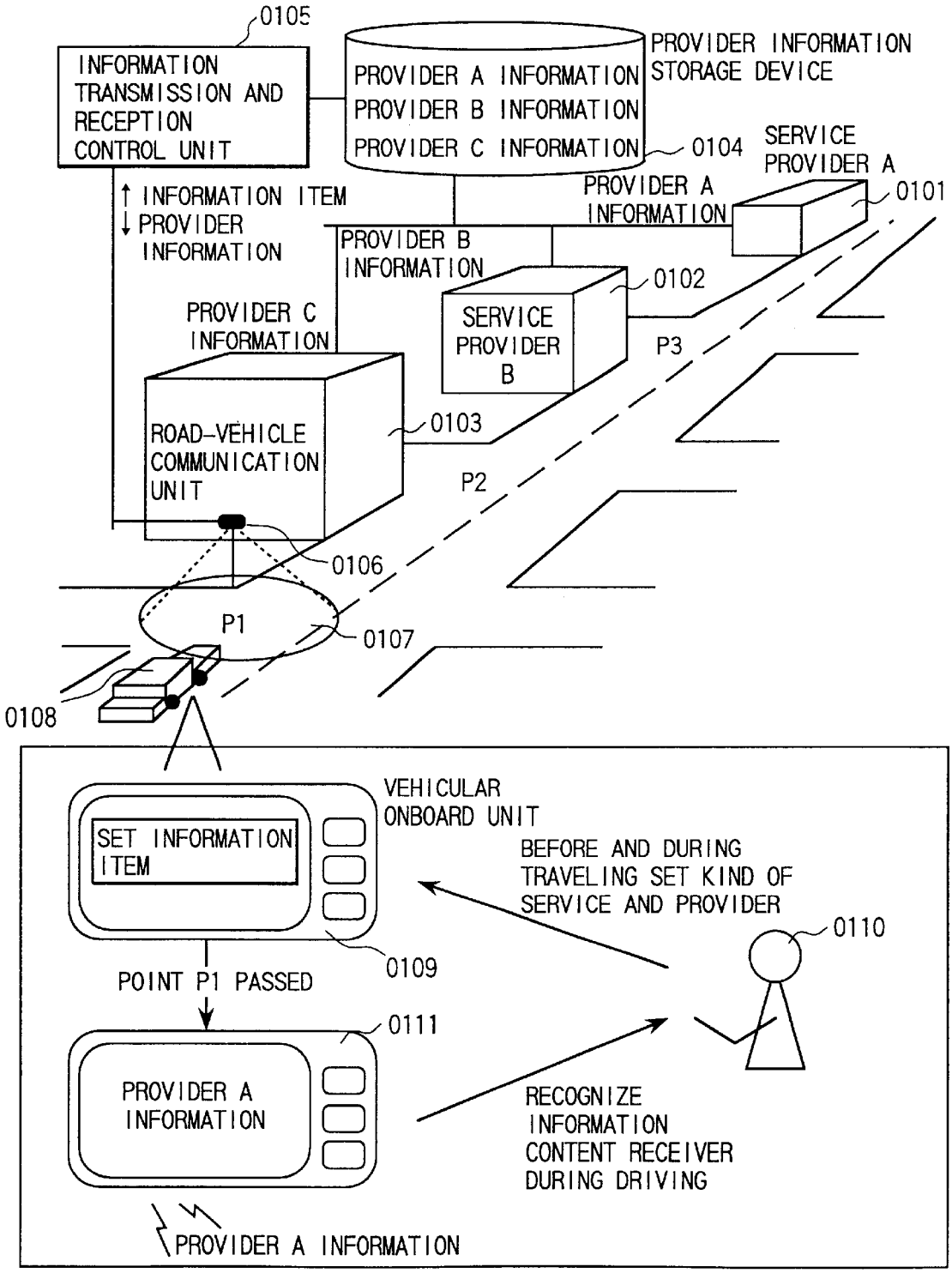
FIG. 1 is an explanatory illustration showing a typical system construction of an information exchange system according to the present invention.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Before detailed discussion of various embodiments of the present invention, general idea of the present invention will be discussed for assisting understanding of the various embodiments set forth later.

In a system providing traffic information as in the prior art, information is selected amount a communication means (hereinafter referred to as "beacon") of a road-vehicle communication system. In contrast to this, in order to accomplish the above-mentioned objects, according to the present invention, in an information exchange system including a vehicle-mounted unit and a road-side unit for providing information in one direction through a road-vehicle radio communication, in order to appropriately transmit a service information of the service provider located along a road for providing services to a vehicle, at first, instead of beacon (which will also be referred to as "road-vehicle communication unit"), a range centered to the service provider is thought of. Thus, with a standard differentiated for each service provider, it becomes possible to determine what information is to be transmitted to each beacon.

Furthermore, information content to be provided to the vehicle is varied in the content and amount of the information to be transmitted to be vehicle mounting the road-vehicle communication unit and passing through a communication region of the beacon, depending upon relative position of the service provider and the beacon.

Particularly, on the side of road, information relating to a plurality of service providers and a plurality of editable information obtained relating to a particular service provider are preliminary stored. Then, by editing the stored information depending upon the relative position, information to be transmitted from the beacon is generated. Here, the relative position includes a distance therebetween or whether both are present on the road and so forth.

Further particularly, when a distance between the service provider and the beacon is large, only brief information having low degree of detail is transmitted from such beacon.

According to approaching to the service provider, information of the service content to be provided becomes more detail. By this, within a limited communication amount, it becomes possible to effectively provide information in consideration of relative position of the vehicle and the service provider.

On the other hand, the service information transmitted to the vehicle is decoded via the radio communication unit as mounted to transmit character, sign, image, voice and so forth to the driver and/or passenger.

In the present invention, in the vehicle-mounted unit, setting means for setting a condition, such as kind, detail degree or so forth of the service provider and selecting means for selecting information received using the set condition are added so that only necessary information among transmitted information can be transferred to the driver or so forth by setting the condition while vehicle is stopping or during travel by the driver or so forth.

On the other hand, when number of the service providers or information thereof are large, the service providers or information may be classified based on conditions, such as type, kind, attribute, detail degree or so forth, for setting condition for information selection.

On the other hand, as a vehicle-mounted communication means, it becomes possible to directly obtain further detailed information which cannot be obtain by the road-vehicle communication for establishing other radio communication with the particular service provider, by connecting with other radio communication means, such as cellular phone, not only adapted to road-vehicle communication.

On the other hand, when information relating to a plurality of service providers are to be transmitted to the vehicle, it becomes possible to improve easiness of understanding in transferring information to the driver or so forth by varying mode of transfer or resorting order, such as sequential order for displaying or outputting of the information to be output depending upon relative position between the vehicle and each service provider. The resorting process may be performed on the side of road upon editing information to be transmitted from the road-side and also be performed in the vehicle-mounted unit receiving the information edited by the road-side unit.

Furthermore, it is possible to vary degree of enhancement of the information to be transferred to the driver or so forth depending upon distance between the beacon and the vehicle. For example, when a voice output is employed as the transferring means, the information of the service provider at the closer location is output at greater volume than that of the service provider at greater distance. On the other hand, when character output is employed as the transferring means, the character size may be varied depending upon the distance between the beacon and the service provider. In this way, distance to the service provider can be more easily perceived.

On the other hand, it is possible to add editing means for selectively storing information to the storage device, selectively deleting information stored in the storage device or for filtering the information depending upon set condition. With such construction, information transmitted from the road side can be stored as much as the capacity of the storage device permits, and the driver or so forth may review the content of information in safe condition of the vehicle, such as stopping of the vehicle.

Also, on the road-side, in addition to the information relating to the service provider, a time information indicative of the time where each information becomes effective can be stored. Also, means for managing time information is provided to appropriately transmit service content variable depending upon time.

Furthermore, information relating to traveling condition of the vehicle, such as information from the traffic measuring device set on the road-side, illumination information of the traffic light, and so forth, can be obtained. Then, by editing information to be transmitted to the vehicle using the traveling condition indicative information, information amount to be transmitted to the vehicle can be increased and decreased depending upon traveling condition of the vehicle.

The particular construction of the present invention set forth above can be used in unidirectional and bidirectional road-vehicle communication. It should be noted that when bidirectional road-vehicle communication is employed, further effective information exchange becomes possible.

At first, information indicative of the service provider or type of service provider set by the driver or so forth can be used for selection of the information transmitted from the road-side or the service provider. Furthermore, on the road-side, editing of the information to be transmitted to the vehicle utilizing selection information as much as possible, is effected to generate information matching with one desired on the side of the vehicle, for transmitting to the vehicle. By this, limited communication amount can be effectively used by information as actually required for the driver or so forth.

In addition, other than kind, vehicle kind information of the vehicle, destination information directed to the vehicle or so forth can be transmitted from the vehicle to the road-side. Upon editing the content to be transmitted to the vehicle, the preference of information selection may be varied. By this, providing of more detail and efficient information becomes possible.

An information exchange system according to the present invention has a system construction as shown in FIG. 1, for example, in one embodiment. The shown embodiment of the information exchange system is constructed with a vehicle-mounted unit which will be discussed later, and a road-side unit which includes a service provider information storage device 0104, an information transmission and reception control unit 0105 and a road-vehicle communication unit 0106.

In the shown embodiment, along the road, a service provider A (0101), a service provider B (0102) and a service provider C (0103) providing services, such as restaurant, gasoline station, shop and so forth, are arranged. Service information provided by these service providers is transmitted to a vehicle through road-vehicle communication. Information concerning each individual service provider is transmitted to the service provider information storage device 0104 and accumulated and managed therein.

It should be noted that throughout the disclosure and claims, the word "service provider" represents business organization or its business station which can provide predetermined perquisites or services for a driver and/or passenger (hereinafter generally referred to as driver or so forth and occasionally referred to as vehicular occupant) of the vehicle visiting a place of business. Also, as information to be provided by the service provider, in addition to the content of the predetermined perquisites or services per se, various information relating to content of business, business organization per se or the business station to be noticed or advertised to the driver and/or passenger of the vehicle, such as information of a parking space available for visitors of the service provider or state of vacancy of the parking space.

The information transmission and reception control unit 0105 serves for editing information of the service provider information storage device 0104 and generating an information to be transmitted to the vehicle. Then, the edited information is transmitted to the vehicle coming into a communication region 0107 by the road-vehicle communication device 0106. On the other hand, when a bidirectional road-vehicle communication is employed, in which information is also transmitted from the vehicle, the information is received in the information transmission and reception control unit 0105 via the road-vehicle communication unit 0106. The information transmission and reception control unit 0105 parses the received information and performs edition of the information using the parsed information.

It should be noted that the road-vehicle communication device 0106 performs unidirectional and bidirectional communication to the vehicle-mounted unit mounted on a vehicle, such as automotive vehicle, traveling on the road. The road-vehicle communication device 0106 can be realized employing the VICS or other system discussed in the discussion of the prior art.

The vehicle-mounted unit 0201 includes a road-vehicle communication device 0202 performing unidirectional (from road side to vehicle side) or bidirectional communication, an information processing unit 0203 processing information from the road-vehicle communication device 0202 or other information input/output device, a voice input device 0205 constructed with a microphone, a voice output device 0206 constructed with a speaker, an information output device 0207 having a liquid crystal display, a head-up display, LED and so forth, and an information input device 0208 having an operation button, a touch panel, a pointing device and other input means. It should be noted that the information processing unit 0203 is provided with an information selecting portion 0204 realizing an information selecting function which will be discussed later.

Returning to FIG. 1, in a vehicle 0108 mounting the foregoing vehicle-mounted unit 0201, information item indicative of service information or kind of the service provider, information of which is desired to be provided, is set before starting or during travel before arriving the communication region 0107 by a driver or so forth 0110. The information item thus input is received by the information input device 0208 and stored in the information selecting portion 0204 or so forth of the information processing unit 0203. A condition of the vehicle-mounted unit 0109 set the information item is illustrated in FIG. 1.

When the vehicle 0107 passes the communication region 0107, the service information is transmitted from the road-side unit 0106 to the vehicle-mounted unit 0109. The information received by the vehicle-mounted unit is transmitted to the driver or so forth 0110 by displaying on a display screen of the information output device 0207 or outputting in an audible voice by the voice output device 0206.

At this time, the information transmitted from the road-side unit is filtered depending upon the preliminarily set information item by the information selecting portion 0204 of the vehicle-mounted unit for distinguishing information to be transmitted to the driver or so forth and information not to be transmitted.

Here, vehicle-mounted units 0109, 0111 and 0201 are all identical units. The vehicle-mounted unit 0201 is shown the internal construction and the vehicle-mounted units 0109 and 0111 are shown in a condition as viewed from the driver or so forth 0110.

On the other hand, when a road-vehicle communication unit 0202 mounted on the vehicle has a function for bidirectional communication, the set information item is transmitted to the information transmission and reception control unit 0105 via the road-vehicle communication unit 0106 of the road-side unit. In the road-side unit, the information to be transmitted to the vehicle is generated by retrieval and editing of information stored depending upon the received information item. The information thus generated is transmitted to the vehicle-mounted unit mounted on the vehicle traveling in the communication region via the road-vehicle communication unit 0106.

Another embodiment of the information exchange system according to the present invention will be discussed with reference to FIGS. 3 to 4 and 15 to 20.

In the shown embodiment, focusing information of a particular service provider, the content of information to be provided is varied depending upon relative position between the communication region of the road-vehicle communication unit of the road-side unit and the service provider.

Figure 2:
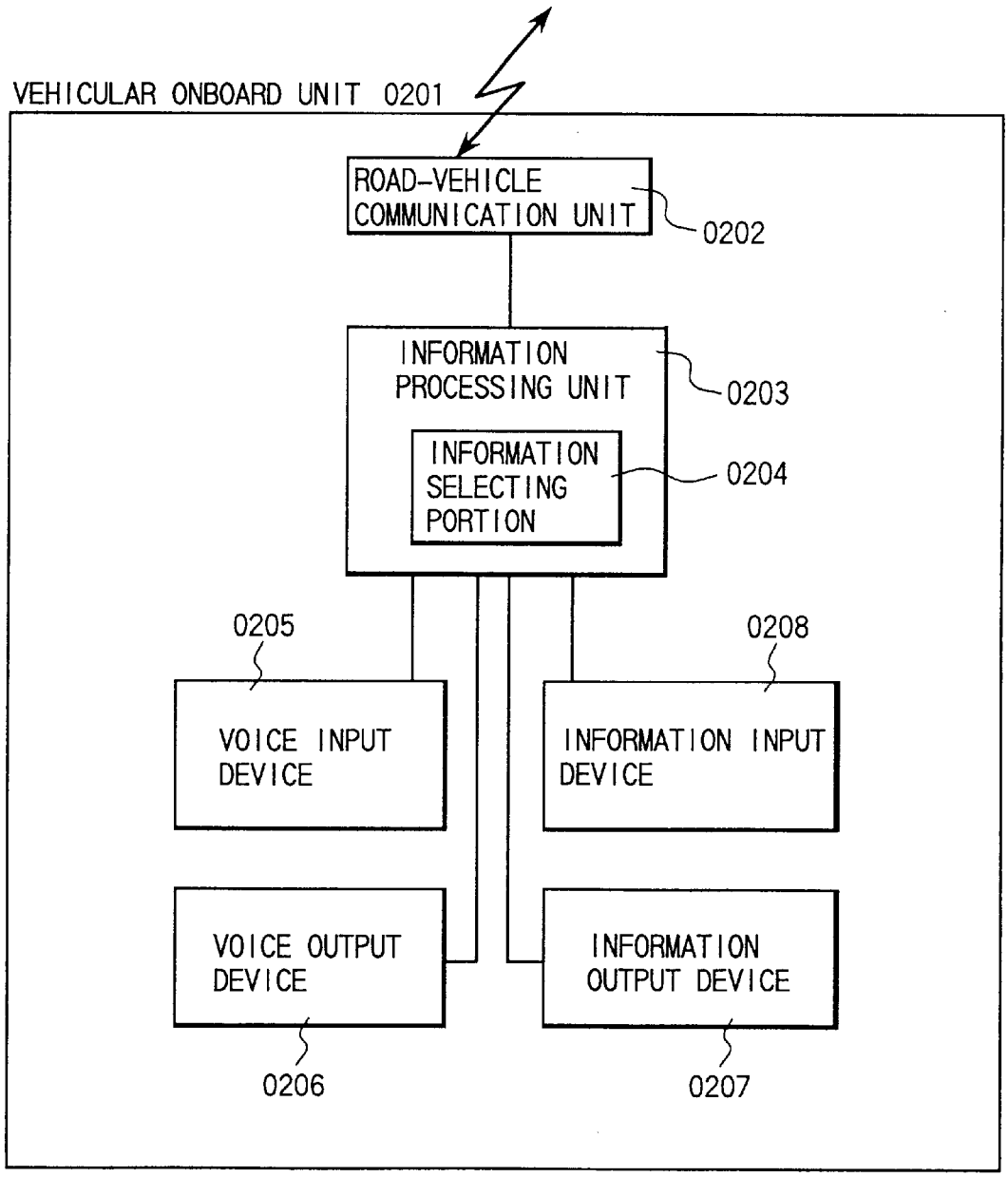
FIG. 2 is a block diagram showing one embodiment of an internal construction of a vehicle-mounted unit.
Figure 3:
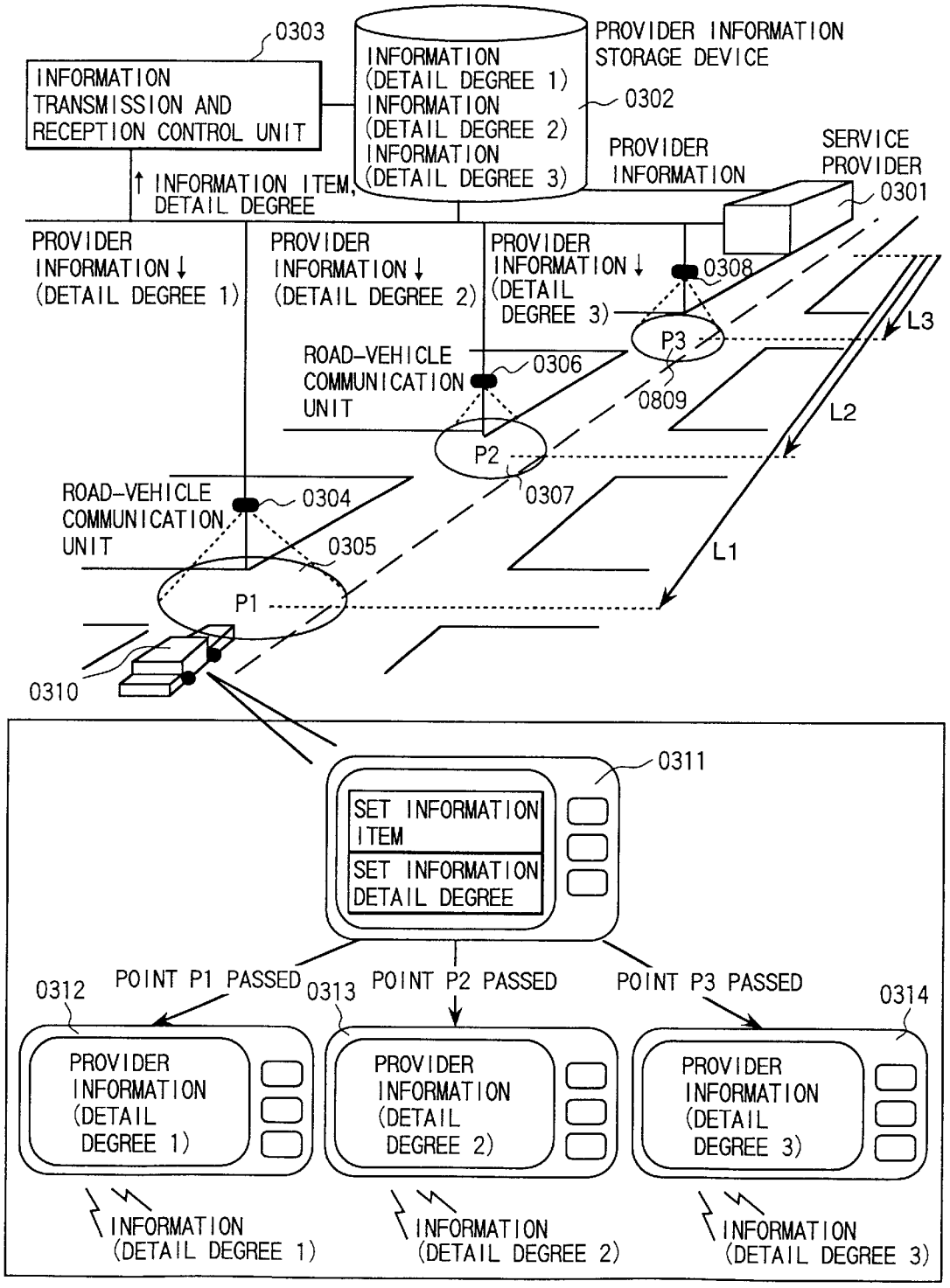
FIG. 3 is an explanatory illustration showing an embodiment of the information exchange system, in which information of different detail degree depending upon a distance between a service provider and a road-vehicle communication unit.

The basic construction of the shown embodiment of the information exchange system is the same as the former embodiment shown in FIGS. 1 and 2. As shown in FIG. 3, the shown embodiment of the information exchange system includes a plurality of road-vehicle communication units 0304, 0306 and 0308 as the road-side units having communication regions at positions distanced from respective service providers at respectively different distances. In the vehicle-mounted unit, means for setting a degree of detail (hereinafter referred to as detail degree) of the information to be provided, in addition to the information item. In the shown embodiment, it is assumed that the installation positions of the road-vehicle communication units and the positions of the communication regions are substantially coincident with each other.

In the shown embodiment, a service provider 0301 transmits information relating to the service content to a service provider information storage device 0302. The information thus stored is separated into a plurality of sub-information depending upon preliminarily set detail degrees. In the example shown in FIG. 3, information is stored with separating into three sub-information corresponding to mutually different three detail degrees.

These information of mutually different detail degrees are selected by the information transmission and reception control unit 303 and transmitted to the vehicle via the road-vehicle communication unit selected corresponding to the each detail degree. Here, three road-vehicle communication units 0304, 0306 and 0308 are installed along the road, the distances from the position of the service provider 0301 and positions where the communication regions are established are assumed to be L1, L2 and L3 (L1>L2>L3), respectively.

The service provider information storage device 0302 stores not only information added with the detail degree but also information indicative of applicable range of the information at respective detail degrees in a form of distance. The information transmission and reception control unit 0303 compares the preliminarily stored position information of the road-vehicle communication unit and the information of the applicable range of the information at respective detail degree stored in the service provider information storage device 0302 to transmit information corresponding to the position to the road-vehicle communication unit.

FIG. 3 shows an example, in which respective information at respective detail degrees are assigned for respective of three road-vehicle communication units. Namely, the information at the detail degree 3 corresponds to a threshold value of the applicable range falling within a range of distance between L3 and L2 from the service provider 0301. Similarly, the information at the detail degree 2 corresponds to a threshold value of the applicable range falling within a range of distance between L2 and L1 from the service provider 0301. Also, the information at the detail degree 1 corresponds to the threshold value of the applicable range falling within a range of distance greater than L1 from the service provider 0301.

It should be noted that while the detail degree is varied depending upon the distance between the road-vehicle communication unit in the road-side unit and the service provider in the shown embodiment, the present invention is not limited to this. For instance, it is also possible to vary the detail degree depending upon relative positional relationship between the service provider and the road-vehicle communication device, namely whether the service provider is located at a location along the road where the road-vehicle communication unit is provided.

A driver of the vehicle 0301 mounting the vehicle-mounted unit sets necessary information item before reaching certain communication region and thus preliminarily sets the detail degree as required. An example of display screen for effecting setting is illustrated in a block 0311.

For example, when setting of information item is selected against a menu, a sub-menu showing information items, such as gasoline station, restaurant, convenience store, supermarket, sightseeing spot, other shop and so forth is displayed on the display screen (information output device 0207). The driver or so forth selects necessary information among respective items in the sub-menu through a button, touch panel and the like. On the other hand, in the menu of setting of detail degree of the information, detail degrees of the information are displayed in a form of figures, e.g. 1, 2, 3 or in a form of words, e.g. brief, normal, detail so that the driver or so forth may select desired degree of detail.

When the vehicle 0301 passes the communication region 0305 of P1, the information at detail degree 1 of the selected kind of service provider is announced to the driver or so forth by way of visual display on the display screen or by way of audible voice (0312). Similarly, when the vehicle passes the communication region 0307 of P2, the information at detail degree 2 is announced to the driver or so forth by way of visual display on the display screen or by way of audible voice (0313). Similarly, when the vehicle passes the communication region 0309 of P3, the information at detail degree 3 is announced to the driver or so forth by way of visual display on the display screen or by way of audible voice (0314). In the example shown in FIG. 3, there is illustrated an example, in which only information item is set and the detail degree of the information is not set. When the detail degree of the information is set, upon reception of the information contained in the information corresponding to the detail degree of information as set, the information is announced to the driver or so forth.

On the other hand, when the vehicle-mounted unit mounted on the vehicle 0210 has a bidirectional communication function with the road-side unit, the information set against the menu displayed on the display screen represented by 0311 is transmitted from the vehicle-mounted unit to the road-side unit when the vehicle 0301 passes each of the communication regions 0305, 0307, 0309. Then, the information transmission and reception control unit 0303 in the road-side unit performs edition of the information to be transmitted to the vehicle-mounted unit on the basis of the information received from the vehicle-mounted unit. A method of edition of the information is that the information item and detail degree received from the vehicle-mounted unit is parsed, then, the information stored in the service provider storage device 0302 matching with the parsed information is selected and edited for generating information to be transmitted. Particular process for realizing this editing method will be discussed later.

Next, content of information to be exchanged between the shown embodiment of road-vehicle communication units will be discussed with reference to FIG. 4.

In FIG. 4, the reference numeral 0401 shows an example of the information content to be transmitted from the road-side unit to the vehicle-mounted unit. The system may individually transmit the information to a plurality of vehicles. On the other hand, to each individual vehicle, it is possible to transmit an ID set for each vehicle-mounted unit and a plurality of information. Each information is consisted of kind of information (information item), detail degree and content of information. Maximum number of the vehicle and maximum number of the information are determined by communication capacities of the road-side unit and each individual vehicle-mounted unit.

On the other hand, in a broadcasting type communication transmitting the same information to all of the vehicle instead of individual communication, the item of the vehicle-mounted unit is omitted or a particular vehicle-mounted unit ID set for indicating the broadcasting type is used.

In FIG. 4, the reference numeral 0402 shows an example of content for the case where information is transmitted from the vehicle-mounted unit to the road-side unit. At the leading end, the vehicle-mounted unit ID set for each vehicle or each vehicle-mounted unit is added, and subsequently, a plurality of information follow. The information is consisted of information for which the driver or so forth desired to be provided, information to be provided and or kind of provider (information item) set with respect to the service provider, and detail degree. Thus, by setting kind of information or the detail degree at various values, various demands can be transmitted to the road-side unit.

For example, variation of setting of information is to set only the kind of information, not set the detail degree, set only detail degree and not set the kind of information and so forth. Maximum number of information to be transmitted to the road-side unit is determined by communication capacity.

Next, operation of the vehicle-mounted and example of display will be discussed with reference to FIGS. 15A to 15D. Hereinafter, information is displayed on the display (information output device 0207). On the other hand, through the touch panel (information input device 0208), the driver and so forth may select the information to be displayed on the displayed on the display screen.

In FIGS. 15A to 15D, FIG. 15A shows an example of a menu of a plurality of information item which can be displayed on a display 1401. The reference numeral 1402 is a button for switching the display screen for displaying a map of a navigation system, 1403 denotes a button for switching the display on the display screen for operation an air conditioner system, 1404 denotes a button for switching the display on the display screen for operating an audio system, and 1405 denotes a button for switching the display on the display screen for setting service provider information according to the present invention, along the road.

Figure 15A:
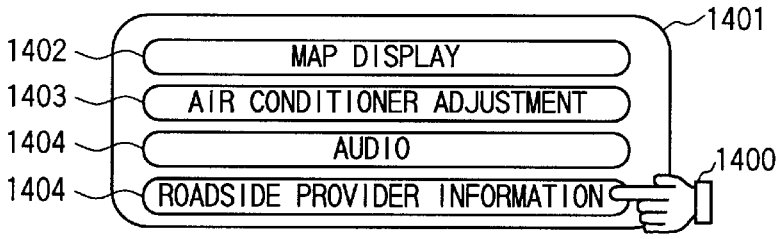
FIGS. 15A to 15D are explanatory illustrations showing examples of display of the vehicle-mounted unit in the embodiment shown in FIG. 3.

On the display screen of FIG. 15A, at first, the driver and so forth performs setting of the service provider information along road by pushing the button of 1405. The operation has to be set before obtaining information via the road-vehicle communication units. However, by default setting upon initiation of operation of the vehicle-mounted unit, the function can be initiated simultaneously with initiation of operation.

Figure 15B:
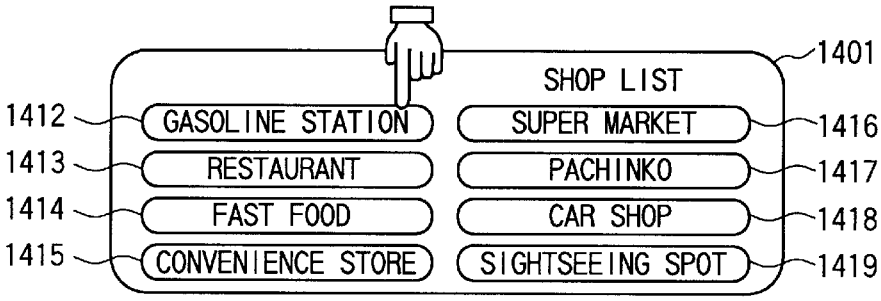

An example of screen to be displayed by pushing the button 1405 is shown in FIG. 15B. Here, as service providers to be selected, gasoline station 1412, restaurant 1413, fast food 1414, convenience store 1415, super market 1416, pachinko shop 1417, car-shop 1418, sightseeing 1419. Respective items to be selected are displayed in a form of buttons. By pushing the button corresponding to the information desired to obtain, the selected information can be obtained upon passing through the communication region. On the other hand, by setting a mode for setting the detail degree on one button, detail degree of the information to be obtained can be set. For instance, the button for setting the detail degree may be operated to select desired detail degree by changing selection in sequential order of pushing in such a manner that the detail degree 1 is selected by pushing once, the detail degree 2 is selected by pushing twice, the detail degree 3 is selected by pushing three times and not select is selected by pushing four times. On the other hand, it is also possible to provide the button for setting detail degree on the display 1401 for varying selection of the detail degree depending upon its operation.

The word "pachinko" is a game like a pinball, which has been disclosed in U.S. Pat. No. 5,509,654, to Takatoshi Takemoto et al., for "Game Machine Employing Metal Bodies as its Media", U.S. Pat. No. 5,405,143, to Takatoshi Takemoto et al., for "Apparatus with Function of Detecting Location of Metal Body", U.S. Pat. No. 5,388,828, to Takatoshi, Takemoto et al., for "Apparatus with Function of Detecting Position of Existence of Metal Body", U.S. Pat. No. 5,769,416, to Takatoshi Takemoto et al., for "Metallic Body Detecting Apparatus". The disclosure of the above-identified U.S. Patents will be herein incorporated by reference for the sake of disclosure.

Next, discussion will be given for example of content of reception information in the case where gasoline station 1412 is selected on the display screen of FIG. 15B. As the information to be provided when the gasoline station 1412 is selected, at first, at the detail degree 1, the information whether the gasoline station 1412 is in operation, is displayed. As the simplest information, in operation and out of operation may be distinguished. As more detailed information, business hour, regular holiday may also be displayed. As information at the detail degree 2, information relating to unit prices of typical items, such as gasoline, diesel oil and so forth. Also, as information at the detail degree 3, information of goods for sale other than major items for sale and time service prices and other time dependent merchandise information.

Figure 15C:
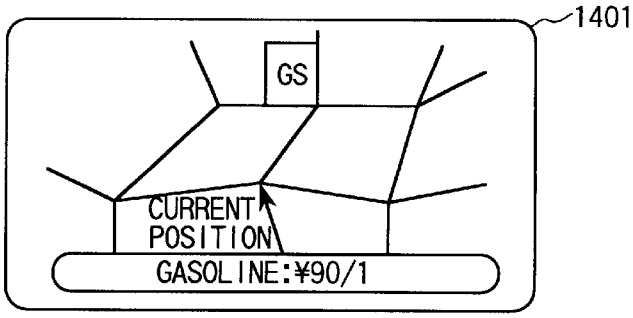
Figure 15D:
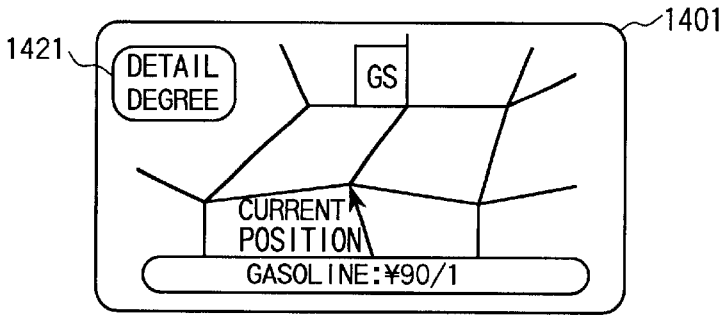

After the foregoing setting, the vehicle sequentially receives information of higher degree of detail as approaching to the gasoline station, while traveling. By displaying the received information overlapping on the map, a positional relationship between the current traveling position and the gasoline station can be easily recognized. An example, showing positions of the current position of the vehicle and the gasoline station, and information of a unit price of gasoline as information relating to the relevant gasoline station, on the map, is illustrated in FIG. 15C. On the other hand, as shown in FIG. 15D, a button 1421 for changing detail degree of the information to be displayed on the display 1401, may be further provided for changing the detail degree of the currently displayed information.

Furthermore, it is possible to construct the system to store information in the storage device incorporated in the vehicle mounted unit to see the information again by selecting the information concerning the gasoline station through the touch panel or so forth, later on. Furthermore, if a plurality of gasoline stations are present, for example, it is possible to display information of a plurality of gasoline station at the same detail degree simultaneously overlying over the map, or in a form of list, to facilitate to know which gasoline station is the cheapest.

The foregoing is similarly applicable for restaurant (detail degree 1: opening hours; detail degree 2: typical menu and price; detail degree 3: degree of crowd in the restaurant), fast food (detail degree 1: opening hours; detail degree 2: typical menu and price; detail degree 3: lunch menu and degree of crowd in the restaurant), convenience store (detail degree 1: store hours; detail degree 2: articles on sale; detail degree 3: incoming state of lunch box, stock condition), super market (detail degree 1: store hours; detail degree 2: articles special sale; detail degree 3: time service articles), pachinko shop (detail degree 1: shop hours; detail degree 2: count of discharged metal balls; detail degree 3: degree of crowd of the shop), as shown in FIG. 15, for selection.

Figure 16:
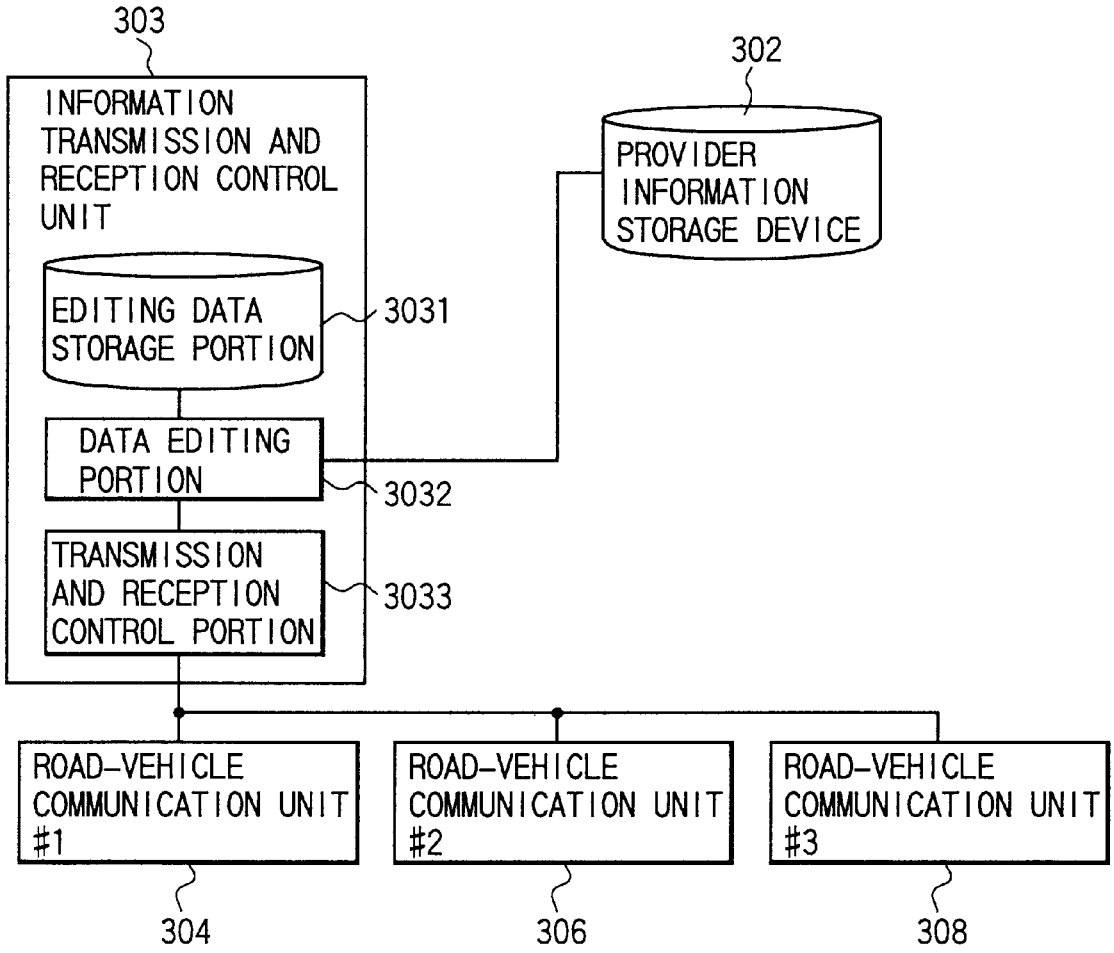
FIG. 16 is a block diagram showing an example of a construction of an information transmission and reception control unit in the embodiment of FIG. 3.
Figure 17:
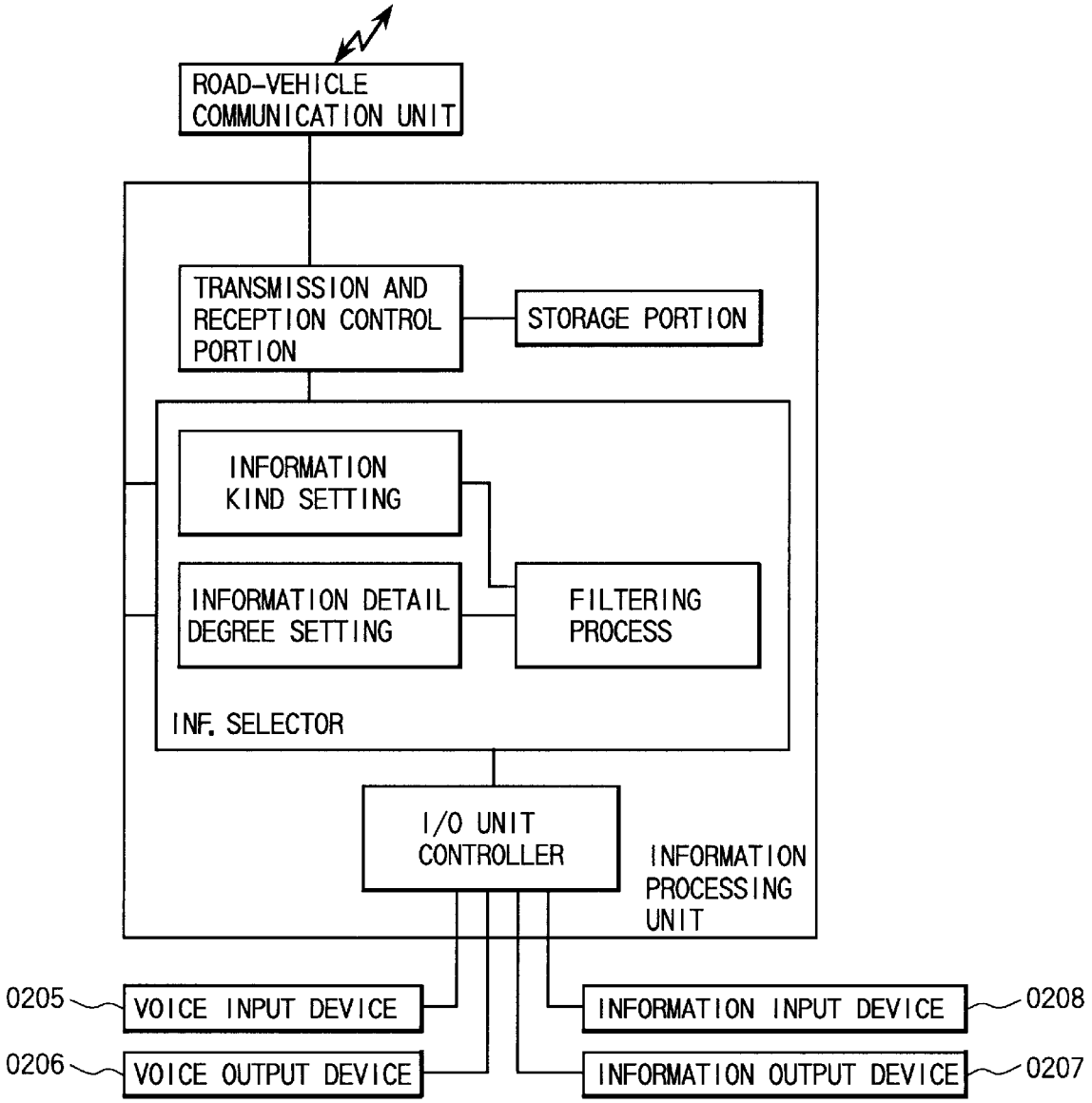
FIG. 17 is a block diagram showing an example of a construction of the vehicle-mounted unit in the embodiment of FIG. 3.

Next, an example of constructions of the road-side unit and the vehicle-mounted unit constructing the shown embodiment of the information exchange system for performing the foregoing process will be illustrated in FIGS. 16 and 17.

As shown in FIG. 16, the road-side unit includes a service provider information storage device 302 storing a plurality of information provided by the service provider at different degrees of detail, a plurality of road-vehicle communication units 304, 306 and 308 performing road-vehicle radio communication with the vehicle-mounted unit, and an information transmission and reception control unit 303 performing edition of information to be transmitted and performing communication control and so forth.

The information transmission and reception control unit 303 includes a data editing portion 3032 editing group of information stored in the service provider information storage device 302 and generating information to be transmitted from each road-vehicle communication unit, an edited data storage portion 3031 storing the information generated by the data editing portion, and a transmission and reception control portion 3033 performing communication control per road-vehicle communication unit.

A basic construction of the shown embodiment of the vehicle-mounted unit includes a road-vehicle communication unit 0202 performing data communication with the road-vehicle communication unit, an information processing unit 0203 for processing received information, a voice input device 0205, a voice output device 0206, an information output device 0207 and an information input device 0208.

In the shown embodiment, the information processing unit 0203 includes a transmission and reception control portion 0231 performing radio communication via the road-vehicle communication unit 0202, a storage portion 0232 storing the received information or so forth, an information selecting portion 0204 performing setting of kind of information which the drivers or so forth desires and detail degree, and filtering process of the received information, and input/output device control portion 02033 interfacing with various input/output devices 0205 to 0208, as shown in FIG. 17, for example.

The information selecting portion 0204 includes information kind setting means 02041 for setting kinds and items of service information which the driver and so forth desired to have, information detail degree setting means for setting detail degree of service information which the driver or so forth desired to be provided, and a filtering processing means 02043 for filtering the received information as required on the basis of set kind and detail degree of the information.

Next, discussion will be given for typical process procedure of the shown embodiment of the information exchange system.

Figure 18:
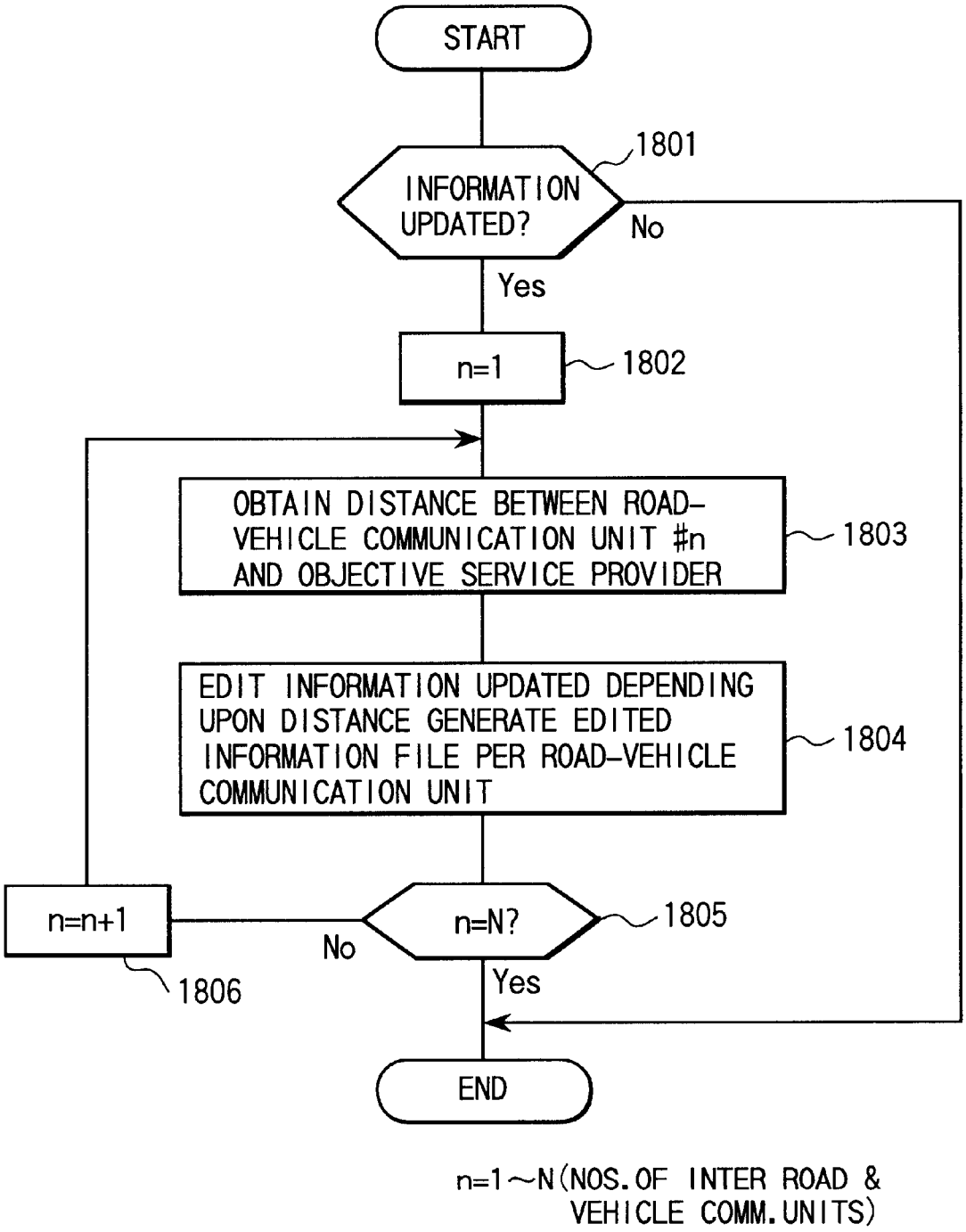
FIG. 18 is a flowchart showing an editing process of provider information depending upon a distance between each road-vehicle communication unit and a service provider.

Initially, one example of editing process procedure of the service provider information depending upon a distance between the road-vehicle communication unit and the service provider to be performed in the data editing portion 3032 of the road-side unit of FIG. 16, will be discussed with reference to FIG. 18.

In the shown process, monitoring is performed whether the service provider information available to provide for the vehicle-mounted unit in the service provider information storage device 302, is updated or not (step 1801). When the service provider information is updated, editing process of the information to be provided for each road-vehicle communication unit is performed.

Namely, after setting of an initial value of a variable n identifying the corresponding road-vehicle communication unit (step 1802), a distance between the service provider providing the updated information and the road-vehicle communication unit #n is derived (step 1803). Furthermore, the updated information is edited depending upon the derived distance to generate an information file indicative containing service information to be transmitted from the road-vehicle communication unit #n. Then, the information file thus generated is stored in the edited data storage portion 3031 (step 1804).

Subsequently, check is performed whether the variable n matches with the maximum value N of number of the road-vehicle communication unit in the road-side unit (step 1805). If not matched, the value of the variable n is incremented by 1 (step 1806) to return to the step 1803.

If judgment is made that information is not updated, the process goes end.

By cyclically executing the shown editing process, the most recent information can always be prepared in the editing data storage portion 3031. Therefore, the most recent service information can always be provided to the vehicle-mounted unit, quickly and efficiently.

Next, one example of the procedure for providing service information to the vehicle-mounted unit, which is performed by the road-side unit shown in FIG. 16, will be discussed with reference to FIG. 19.

Respective road-vehicle communication units #1, #2 and #3 of the road-side unit monitors respective of own communication regions for detecting the vehicle mounting the vehicle-mounted unit having the vehicle side road-vehicle communication unit which can communicate with the road-vehicle communication units of the road-side units, traveling through the communication regions thereof, by detecting a particular ID signal transmitted from the vehicle-mounted unit according to a predetermined communication protocol.

In the shown process, at first, a result of monitoring is received from respective road-vehicle communication units located on the road side for making judgment whether the vehicle mounting the vehicle-mounted unit for which service information can be provided, is present in respective of the communication regions of respective road-vehicle communication units (step 1901). If the vehicle mounting the vehicle-mounted unit is present in the own communication region, the information file edited and generated for the road-vehicle communication unit having the communication region where the vehicle is traveling, is read out from the edited data storage portion 3031 by the data editing portion 3032 (step 1902).

Furthermore, a condition relating to the kind and detail degree of the information set with respect to the service information, for which the driver or so forth of the vehicle detected in one of the communication region in a manner set froth above, desires to be provided, transmitted from the vehicle-mounted unit of the vehicle in question, is received by the transmission and reception control unit 3033 (step 1903). On the basis of the information of the information kind and so forth, the data editing portion 3032 further edits the obtained information file to generate the information to be transmitted to the relevant vehicle (step 1904). The transmission and reception control unit 3033 controls operation of the road-vehicle communication unit so that the information thus generated is transmitted from the road-vehicle communication unit which detects presence of the relevant vehicle within its own communication region (step 1905).

It should be noted that a protocol to be used in road-vehicle communication in the present invention is not particularly specified and various known communication protocols may be used.

Next, a procedure of information obtaining process to be performed by the vehicle-mounted unit, which procedure is executed corresponding to the information providing process performed by the road-side unit of FIG. 19, will be discussed with reference to FIG. 20.

Figure 19:
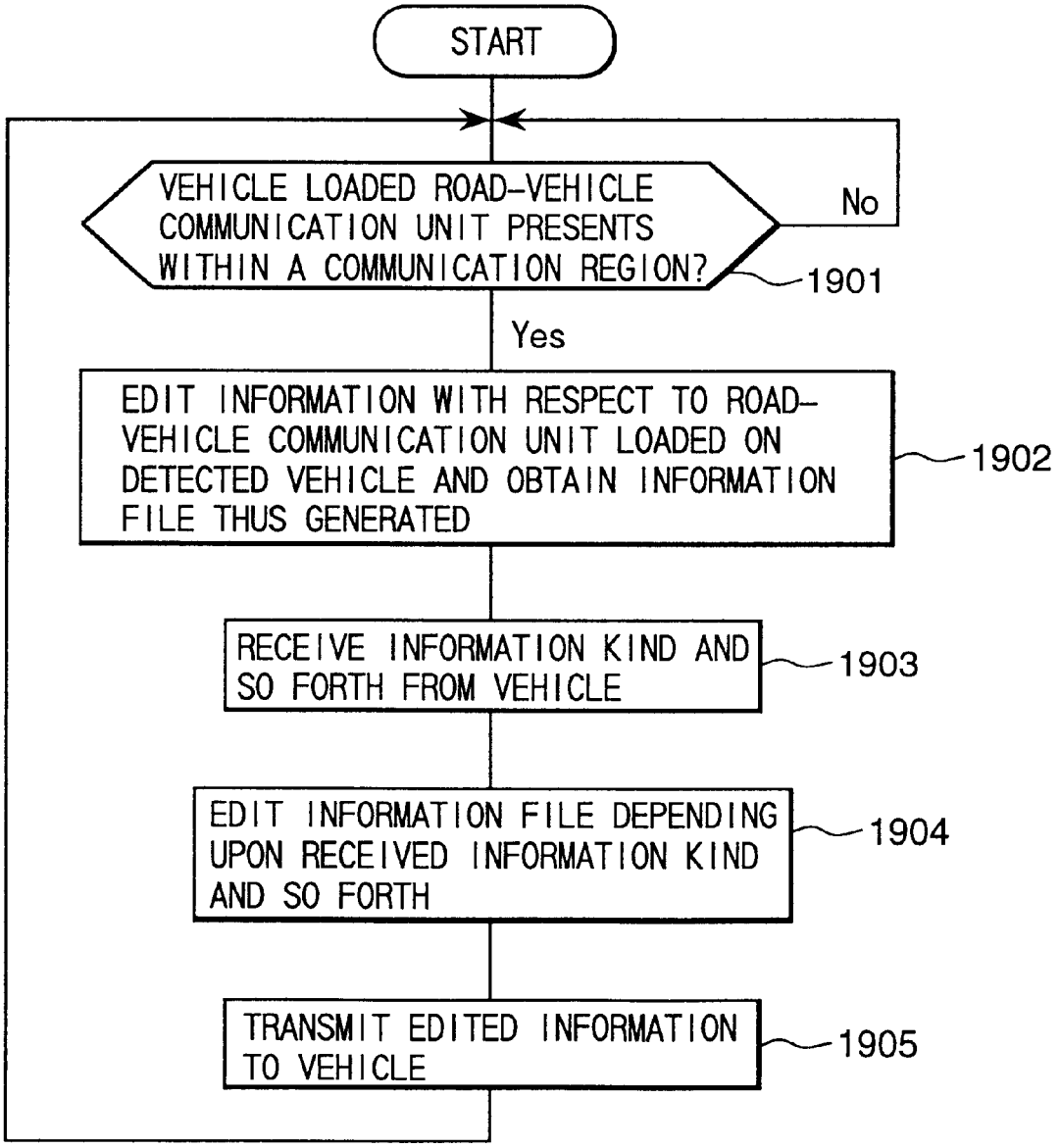
FIG. 19 is a flowchart showing an example of process to be executed by the road-side unit in the case where the vehicle passes through a communication range of the road-vehicle communication unit.

The vehicle-mounted unit makes judgment whether the region where the vehicle mounting the own vehicle-mounted unit is in travel, is the communication region of one of the road-vehicle communication units for permitting road-vehicle radio communication, by detecting a signal indicative of presence of the communication region transmitted from the road-vehicle communication unit of the road-side unit, such as a beacon signal, for example, according to the communication protocol used in the process shown in FIG. 19 (step 2001).

When the communication region is detected, the service information which the driver or so forth desires to be provided through the information kind setting means 02041 of the vehicle-mounted unit (see FIG. 17), kind or item of the service provider, or detail degree of information set by the information detail degree setting means 02042 is transmitted to the road-side unit via the transmission and reception control portion 02031 and the road-vehicle communication unit 0202 (step 2002).

The information edited by the road-side unit depending upon the information kind or so forth transmitted at step 2002 is received by the transmission and reception control unit 02031 and the road-vehicle communication unit 0202 and stored in the storage device 02032 (step 2003). The filtering processing means 02043 transmits the stored information to the driver or so forth through filtering as required (step 2004) and via the voice output device 0206 and the information output device 0207, on the basis of the preliminarily set information kind or so forth (step 2005).

Figure 20:
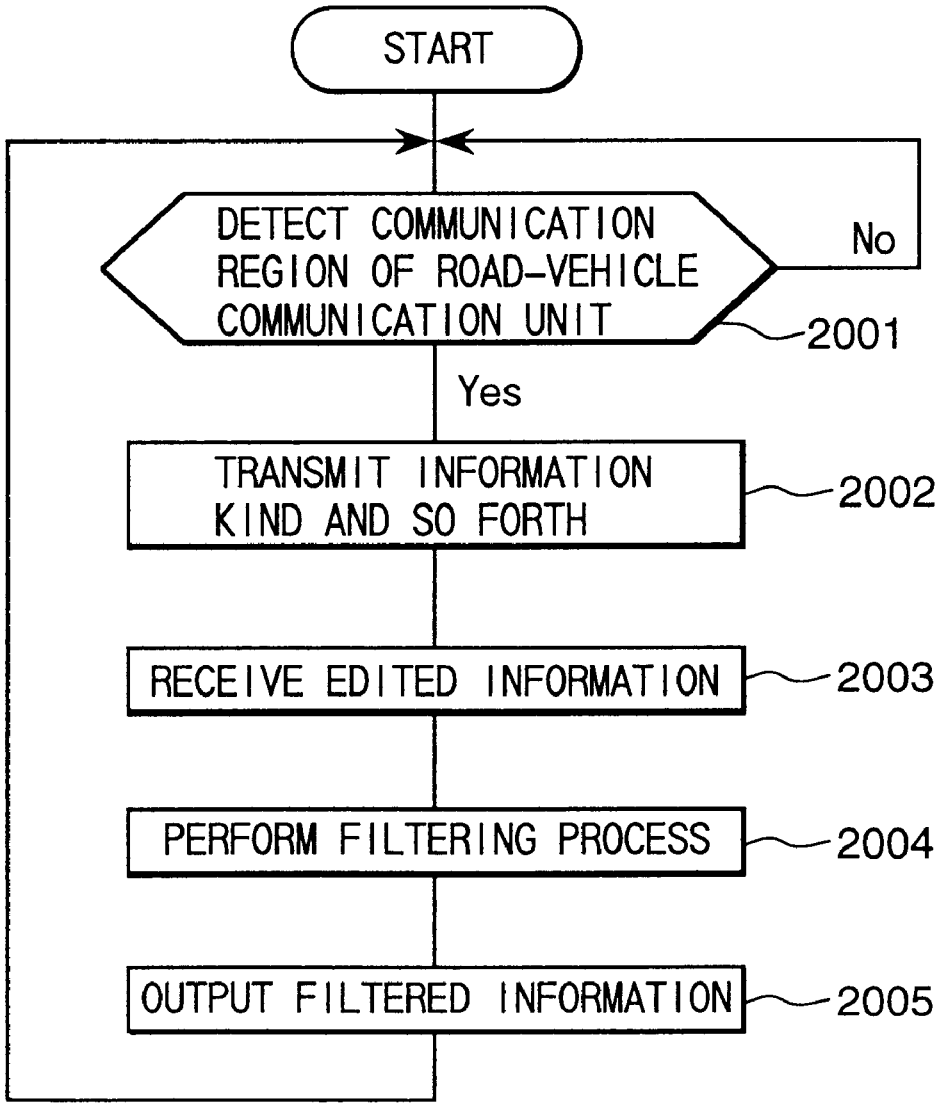
FIG. 20 is a flowchart showing an example of process of a road-mounted unit in the case where the vehicle passes through the communication range of the road-vehicle communication unit.

By the processing procedure shown in FIGS. 19 and 20, utilizing the road-vehicle communication, the service information suited to what the driver or so forth desires, can be provided more efficiently.

Next, another embodiment of the information exchange system, to which the present invention is applied, will be discussed with reference to FIG. 5. In the shown embodiment, the information of the service provider is transmitted to the driver or so forth by a system, in which the road-vehicle radio communication and other communication means are combined.

In the shown embodiment of the system, similarly to the information exchange system shown in FIG. 1, service provider A (0501), service provider B (0502) and service provider (0503) are located along the road, on which a vehicle 0508 travels. Information of each service provider is transmitted to a service provider information storage device 0504 to be stored and managed therein.

An information transmission and reception control units 0505 serves for editing information to be transmitted to the vehicle using the information of the service provider information storage device 0504. The information edited in the information transmission and reception control unit 0505 is transmitted to the vehicle 0508 entering into to a communication region 0507 by a road-vehicle communication unit 0506. On the other hand, when the information is transmitted from the vehicle 0508, the information is transmitted to the information transmission and reception control unit 0505 via the road-vehicle communication unit 0506 and parsed by the information transmission and reception control unit 0505. Then, the information transmission and reception control unit 0505 edits a transmission information.

The vehicle-mounted unit mounted on the vehicle 0608 is set the information item desired to be provided before reaching the communication region 0507. The reference numeral 0509 represents a display screen of the vehicle-mounted unit suited for setting the information item. Next, when the vehicle passes through the communication region 0507, and if the information of the service provider A among the information transmitted from the road-side unit matches with the content set in the vehicle-mounted unit, the information is provided to the driver or so forth by visible display, audible voice or so forth as represented by 0510.

Furthermore, in the shown embodiment of the vehicle-mounted unit, means for selecting one of displayed service providers or one of the information thereof and means for performing automatic transmission or data transmission and reception by connecting with the selected service provider or the service provider corresponding to the selected information through a public circuit, such as car phone, cellular phone and so forth (0512), are added for the system of the embodiment illustrated in FIG. 3, for example.

On the other hand, corresponding to the above, on the side of the service provider, a system is provided a construction for answering to the demand for information from the driver or so forth. More particularly, for example, as shown in FIG. 5, in the service provider A, a personnel 0513 is assigned for answering to inquiry or request over telephone, or, in the alternative, information transmission and reception control unit for performing more detailed information exchange and information database (DB) (0514) therefor may be introduced.

In the shown embodiment, at a condition where the content of display as represented by 0610 is displayed in the vehicle-mounted unit, when a demand for more detail information for the selected particular service provider is set by selecting the particular service provider by operation of the driver or so forth, the vehicle-mounted unit is automatically connected to the service provider A through a telephone 0512. Thus, necessary information can be obtained.

In order to realize the foregoing function, a telephone number for establishing direct connection may be included in the content of the information transmitted from the road-side unit, or, in the alternative, a selection menus, each being dedicated for each particular service provider, may be provided in the vehicle-mounted unit. Furthermore, by utilizing a recently spreading internet technology, it becomes possible to avoid necessity for holding the dedicated selection menus in each vehicle-mounted unit by transmitting the selecting menu function per each service provider from the road-side unit to the vehicle-mounted unit.

By the shown embodiment, since means for enabling to obtain more detailed content as required, in relation to the provided service information is provided, more convenience information exchange system can be established.

Next, discussion will be given for a further embodiment of the information exchange system according to the present invention with reference to FIG. 6. The shown embodiment is constructed by adding a preference providing process for providing preference upon transmitting information content to be transmitted from the road-side unit to the vehicle-mounted unit, to the driver or so forth.

Figure 5:
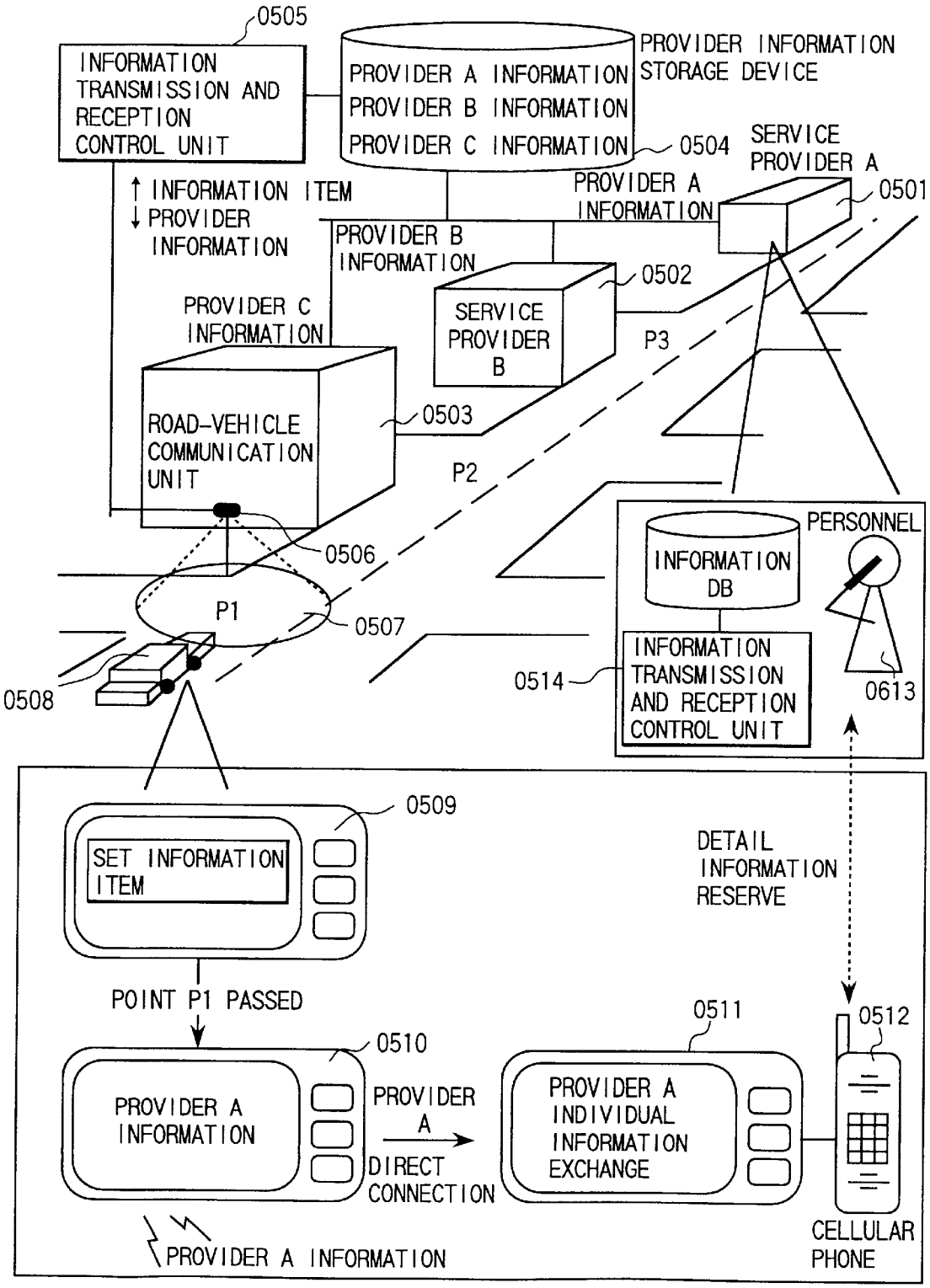
FIG. 5 is an explanatory illustration showing an embodiment of the information exchange system, in which a narrow region road-vehicle communication and a general radio circuit are combined.

In the shown embodiment, a service provider A (0601), a service provider B (0602), a service provider C (0603), a service provider information storage device 0604, an information transmission and reception control unit 0605, road-vehicle communication unit 0606, a communication region 0607 at P1, on the road-side unit, perform substantially the same function as those of the information exchange system of the embodiment shown in FIG. 5.

A vehicle 0608 mounting the vehicle-mounted unit receives information from road-side unit upon passing through the communication region 0607. Here, it is assumed that the information content is transmitted in a sequential order as represented by 0609. In this case, the information content to be transmitted from the road-side unit is added a distance information indicative of a distance between a position of the road-vehicle communication unit which received information provided, namely the position of the vehicle at a time receiving the information, and each service provider.

In the shown embodiment, the vehicle-mounted unit includes means for detecting distance information included in the information transmitted, and means for changing an order of display of the received information in a sequential order from closest to the own vehicle. Re-arranged information per service providers can be transmitted reflecting the distances between the vehicle and the service providers, by displaying as illustrated in 0609, for example.

It is also possible to re-arrange received information in consideration of relative positional relationship whether the relevant service provider is present along the road, on which the vehicle travels, instead of the distance information.

Re-arranging of the information set forth above can be implemented by the information transmission and reception control unit 0605 of the road-side unit. On the other hand, when a map information storage device for displaying a map stored in CD-ROM or the like, is provided in the vehicle-mounted unit, even if the distance information is not contained in the information content transmitted from the road-side unit, re-arranging can be performed by the vehicle-mounted unit alone by deriving the distance between the vehicle and each service provider based on the map information. In this case, it becomes necessary to preliminarily establish matching between the service provider stored in the map information storage device of the vehicle-mounted unit and the service provider transmitted from the road-side unit, by using ID, name or the like.

On the other hand, it is possible to display the information overlying on the map of the vehicle-mounted unit. In this case, in addition to the service content per se, a distance information or traveling time information (various precision levels, such as that based on information transmitted from the road-side unit as in VICS or that simply derived based on the distance and an average speed) may also be displayed (0611).

With the shown embodiment, even when the information relating to a plurality of service providers is received, the service provider closest to own vehicle can be recognized more easily.

Next, a still further embodiment of the information exchange system according to the present invention will be discussed with reference to FIG. 7.

Figure 6:
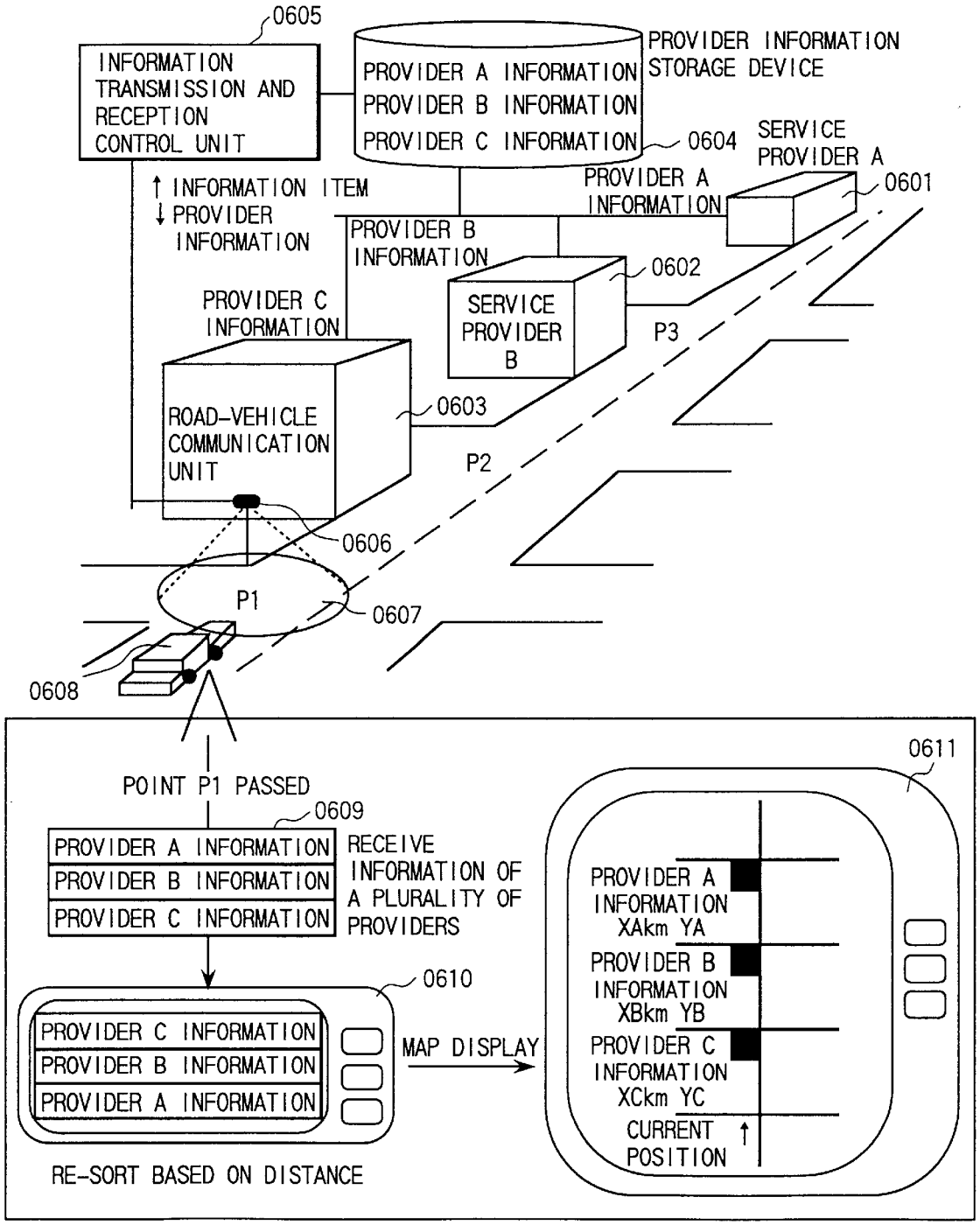
FIG. 6 is an explanatory illustration showing an embodiment of the information exchange system, in which information transmitted are re-sorted depending upon a distance from the service provider.

In the embodiment shown in FIG. 6, the example using the distance for providing preference in transmission of the information. In contrast to this, in the shown embodiment, a system for further enhancing the information content provided preference on the basis of the distance, is employed.

Figure 7:
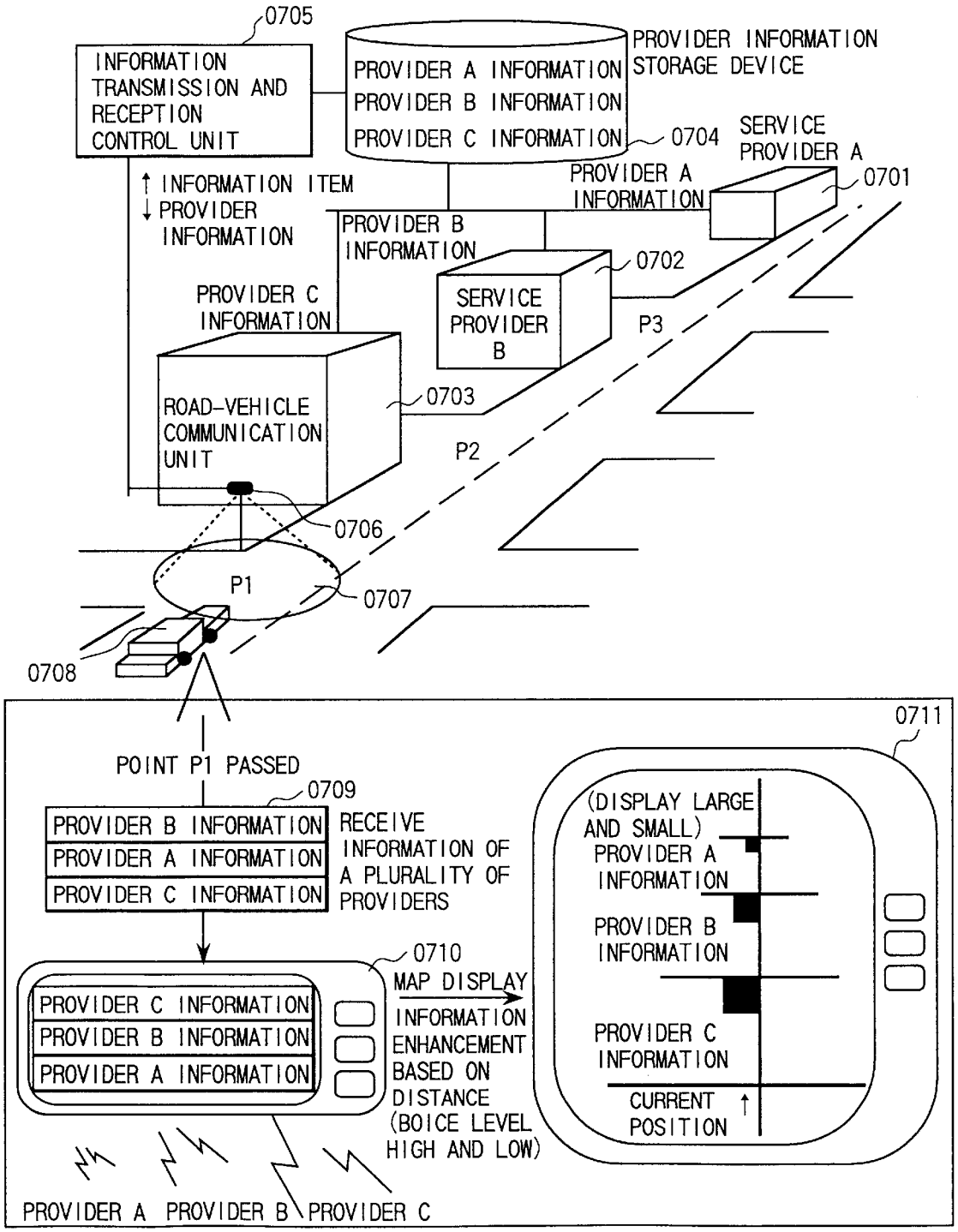
FIG. 7 is an explanatory illustration showing an embodiment of the information exchange system which enhances a voice notice or display of a transmitted information depending a distance from the service provider.

In FIG. 7, a service provider A (0701), a service provider B (0702), a service provider C (0703), a service provider information storage device 0704, an information transmission and reception control unit 0705, road-vehicle communication unit 0706, a communication region 0707 at P1, on the road-side unit, perform substantially the same function as those of the information exchange system of the embodiment shown in FIG. 6.

A vehicle 0708 mounting the vehicle-mounted unit receives information from road-side unit upon passing through the communication region 0707. Here, it is assumed that the information content is transmitted in a sequential order as represented by 0709. While re-arrangement of information is simply effected on the basis of the distance information in the embodiment of FIG. 6, means for controlling the operations of various output devices of the vehicle-mounted unit, is provided.

For example, when the voice output device is provided in the vehicle-mounted unit, a volume level of a voice may be varied so that announcement is made at greater sound for closer service provider (0710). On the other hand, when the information is adapted to display on the display screen, a size of the displayed information is varied so that the information for the closer service provider is displayed on the display screen in greater size (0711). Namely, the means for controlling operation of the output devices may control mode of transmission of information in such a manner that information of the service provider physically located at closer to the driver or so forth distance is more strongly enhanced depending upon the distance.

In the shown embodiment, even if the information of a plurality of service providers is received, the service provider close to the own vehicle can be easily recognized in sense.

Figure 8:
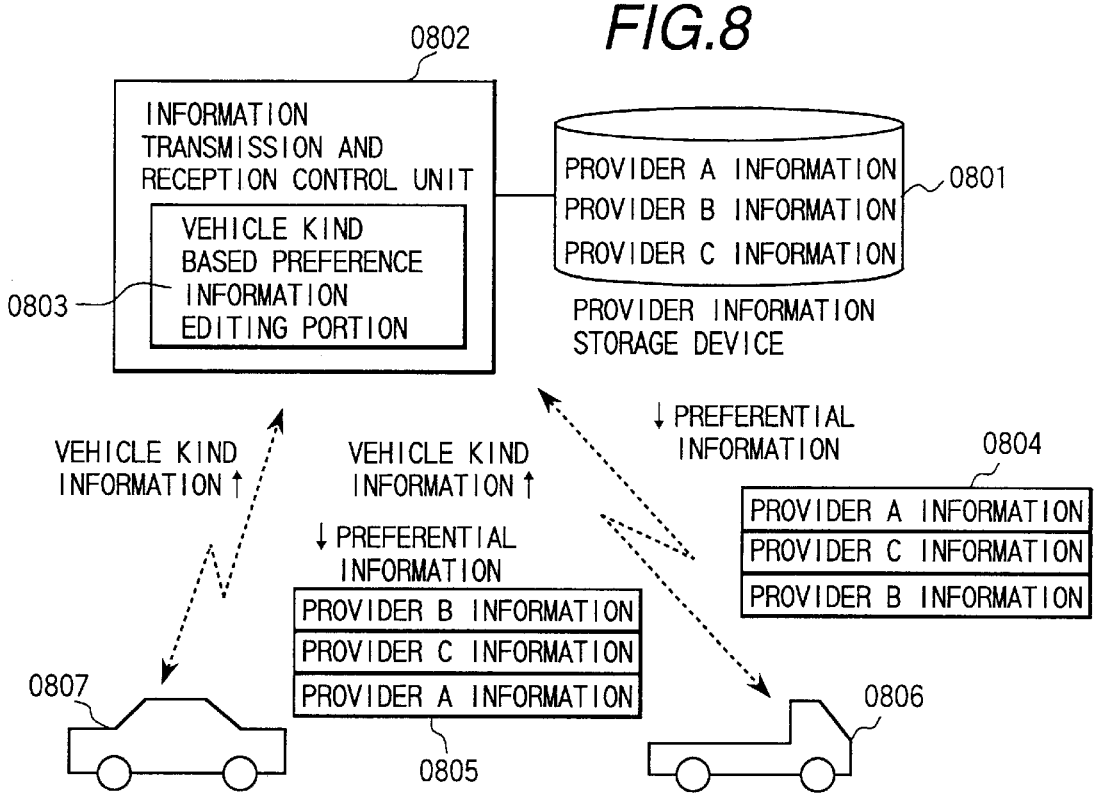
FIG. 8 is an explanatory illustration showing an embodiment which varies preference of edition of information to be transmitted using a vehicle kind information transmitted from the vehicle.

Next, a yet further embodiment of the information exchange system, to which the present invention is applied, will be discussed with reference to FIGS. 8 and 9.

In this embodiment, information editing process depending upon characteristics of the vehicle, in which information is transmitted to each individual vehicle from the road-side unit, and, in conjunction therewith, information is transmitted from the vehicle to the road-side unit, is added. The basic construction of the shown embodiment of the information exchange system is omitted from detailed explanation since the construction is the same as the embodiment of FIG. 3, for example, in order to avoid redundant discussion for keeping the disclosure simple enough to facilitate clear understanding of the present invention.

In the shown embodiment of the information exchange system, the information transmission and reception control unit 0802 of the road-side unit has a function for editing information to the vehicle-mounted unit using the information of the service provider information storage device 0801 and the information transmitted from the vehicle-mounted unit. As the information transmitted from the vehicle-mounted unit, a vehicle kind information of the vehicle mounting the vehicle-mounted unit is included.

More particularly, means for setting vehicle kind of the vehicle is added to the vehicle-mounted unit for transmitting the set vehicle kind information to the road-side unit. Also, in the road-side unit, a vehicle kind based preference information editing portion 0803 is added to the information transmission and reception control unit 0802 for performing editing process for reflecting preference set on the basis of the vehicle kind information of the vehicle transmitted from the vehicle and then for transmitting the information with preference to the vehicle.

For instance, when the transmitted vehicle kind information represents a large-size vehicle, such as a truck, the preference of the service providers is given in a sequential order of ACB. On the other hand, when the transmitted vehicle kind information represents a normal size vehicle, such as a passenger car, the preference of the service provider is given in a sequential order of BCA. Here, the service provider A provides a service more beneficial for the driver or passenger of the large size vehicle rather the normal size vehicle, the service provider provides a service more beneficial for the driver or passenger of the normal size vehicle rather than the large size vehicle. Such nature of each of individual service provider is preliminarily registered.

Figure 9:
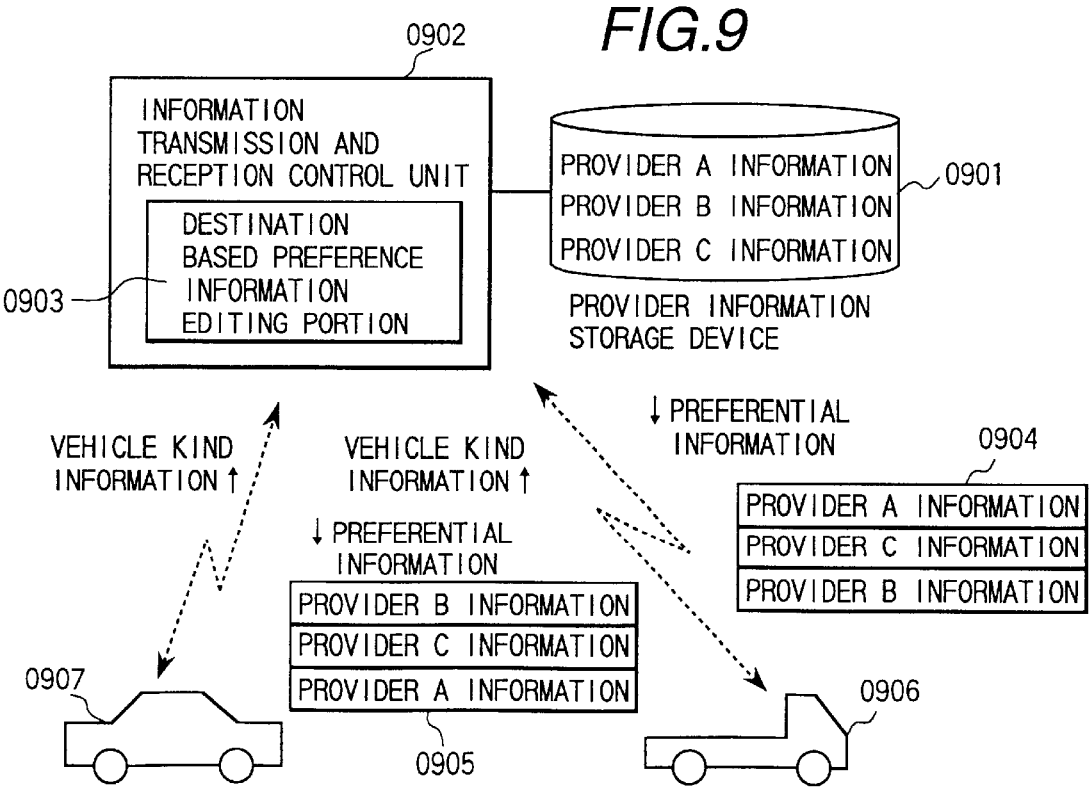
FIG. 9 is an explanatory illustration showing an embodiment of the information exchange system which varies editing preference of information to be fed to the vehicle using a destination information transmitted to the vehicle.

Similarly, in the embodiment shown in FIG. 9, means for setting a destination of the vehicle is added in the vehicle-mounted unit. The destination information thus set is transmitted to the road-side unit. In the road-side unit, a destination based preference information editing portion 0903 for editing information with preference based on the destination for transmitting to the vehicle, using the destination information transmitted from the vehicle, is added to the information transmission and reception control unit 0902 in the road-side unit. The destination based preference information editing portion 0903 performs editing process reflecting preference set on the basis of the destination information to transmit information with the destination dependent preference to the vehicle.

For example, when the destination information of the vehicle 0906 is transmitted, the information is transmitted in the sequential order of the service providers of ACB as shown by 0904. When the destination information is transmitted from the vehicle 0907, the information is transmitted in the sequential order of the service providers of BCA as shown by 0905. Here, the service provider A provides a service beneficial for the driver or so forth directed to the destination set in the vehicle 0906, and the service provider B provides a service beneficial for the driver or so forth directed to the destination set in the vehicle 0907. Correlation between the destinations and nature of services provided by service providers are preliminarily registered.

Next, a still further embodiment of the information exchange system, to which the present invention is applied, will be discussed with reference to FIG. 10.

In the shown embodiment of the information exchange system, a function for editing information or selectively storing and deleting the information transmitted from the vehicle from the road-side unit, is added to the embodiment of the information exchange system of FIG. 3, in the construction of the vehicle-mounted unit (see FIG. 17, for example).

Figure 10:
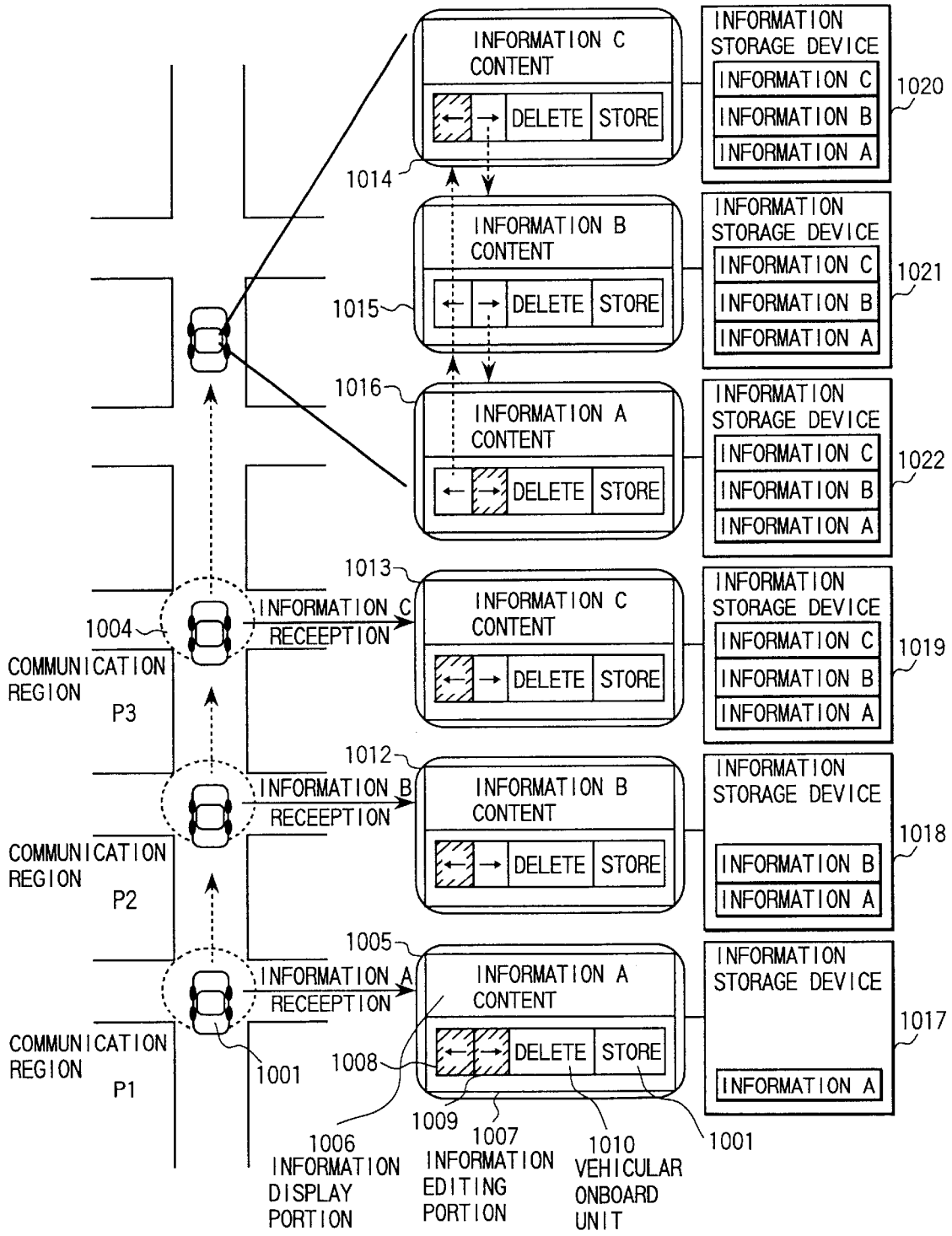
FIG. 10 is an explanatory illustration of an embodiment of the information exchange system which has an edit function of the information transmitted from a vehicle-mounted unit.

FIG. 10 illustrates a road, through which a vehicle 1001 travels, on the left side. In FIG. 10, the vehicle travels from lower side to the upper side to received information from the road-side unit while passing through a communication region 1002 of the road-vehicle communication unit P1, at first. Then, the vehicle travels across the communication region 1003 of the road-vehicle communication unit P2 and the communication region 1004 of the road-vehicle communication unit P3 to receive information from road-side unit in sequential order. 1005 represents an example displaying received information when the vehicle 1001 passes through the communication region 1002.

The shown embodiment of the vehicle-mounted unit 1005 has an information displaying portion 1006 acting as the information output device, and an information editing portion 1007 acting as the information input device. The information displaying portion 1006 displays received information content. The information editing portion 1007 has a function for editing received information. The information editing portion 1007 includes pointer buttons 1008 and 1009 selecting content to display when a plurality of information is stored, a delete button 1010 for deleting displayed content, and a storage button 1011 storing the displayed content.

Information received by the road-side unit is temporarily stored in the information storage device of the vehicle-mounted unit. 1017 shows a condition, in which the information A received by the information storage device upon passing through the communication region 1002 is temporarily stored.

Similarly, upon passing the communication regions 1003 and 1004 in sequential order, conditions receiving respective information B and C are illustrated as 1012 and 1013. On the other hand, the conditions of the information storage device at respective timing of display conditions 1012 and 1013 are illustrated as 1018 and 1019.

In FIG. 10, 1014 shows a condition sama as 1013 which shows the display condition of the vehicle-mounted unit when the vehicle passes through the communication region 1004 of the road-vehicle communication unit P3. By selecting the pointer 1009 on the screen from the condition shown as 1014, the one preceding information can be displayed. This condition is illustrated as 1016. On the other hand, by selecting another pointer 1008, next information can be displayed to transit display condition from the condition of 1016 to the conditions 1015 and 1014. At this time, since deletion of information is not effected in the information storage device, the content is not varied. Thus, respective conditions of 1014, 1015 and 1016 are respectively the same as 1020, 1021 and 1022.

On the other hand, when storing is designated, a special flag is set in the information. By this, when new information is to be stored beyond the upper limit of the storage capacity, other information is deleted by avoiding the information, to which the flag is set.

While the foregoing embodiments are illustrated that the driver or so forth may select information to be stored and deleted, method for storing and deleting information stored in the vehicle-mounted unit applicable for the present invention is not limited to the shown method, but can be any available methods.

The service information received by the vehicle-mounted unit from the service provider can be stored in the storage device in the vehicle-mounted unit. The capacity of the storage device has been quite large in the recent years, it becomes possible to store a substantial amount of information. However, since there is a limitation in the storage capacity even though the large capacity, when information beyond the storage capacity is stored, it becomes necessary to provide a certain way for selectively storing and abandoning in information with least load for the driver or so forth.

The simplest method is to display a message or so forth when the vacant capacity of the storage device becomes smaller than or equal to a given value to prompt deletion of unnecessary information to the user to certainly maintain necessary capacity. In this case, if the vacant capacity is not sufficient, new information will not be stored.

On the other hand, it is also possible to take a method to store time and day information together with information upon storing information and to automatically delete information from the oldest one when lacking of storage capacity is judged.

On the other hand, upon storing information, position information of the vehicle upon reception of the information or position information of the road-vehicle communication unit of the road-side unit which provides the information are stored. Then, when the vehicle passes the location of the service provider as the provider of the information along the road, after traveling for a given distance after passing through the location of the service provider, or when the vehicle travels out of a regional effective range included in the provided information, the relevant information may be deleted or set as candidate for deletion automatically.

On the other hand, it is also possible to add information of effective deletion period in the information to be transmitted to the vehicle-mounted unit, to monitor the effective deletion period in the vehicle-mounted unit to automatically delete the information upon elapse of the effective deletion period. On the other hand, when information is updated from time to time, a version information is added for the information. Then, at a timing where the information is received, if the information of the older version than the received information is held in the storage device, the old information may be deleted automatically to store new information.

While various method for deleting the stored information have been discussed, other methods may also be taken. Also, it is possible to use some methods in combination.

With the deletion method, various information provided from time to time during travel can be efficiently stored even by the storage device having limited storage capacity.

Figure 11:
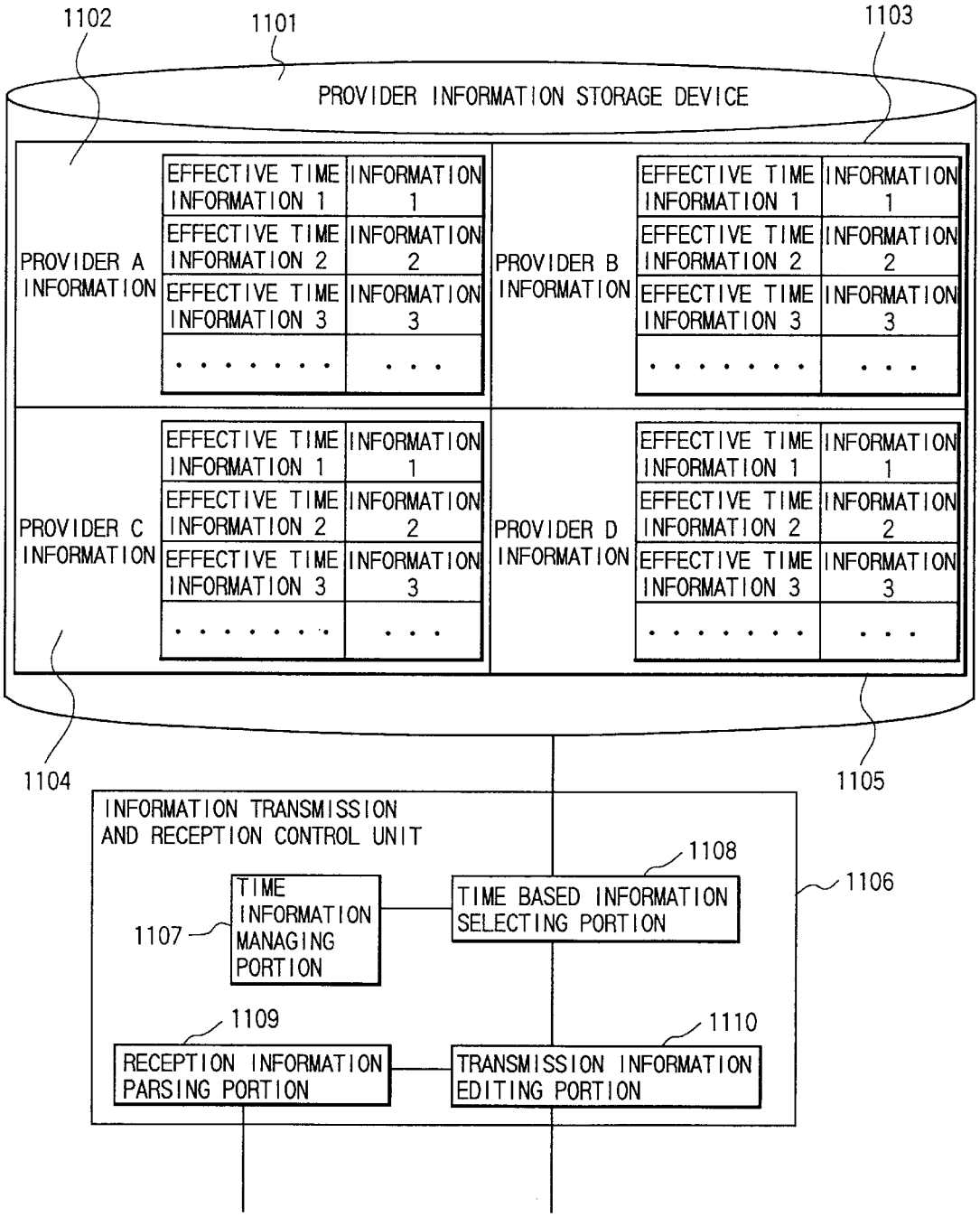
FIG. 11 is a block diagram of an embodiment of the information exchange system using a time-based provider information.

Next, a yet further embodiment of the information exchange system, to which the present invention can be applied, will be discussed with reference to FIG. 11.

The shown embodiment of the information exchange system is applicable for the case where the information of the service provider can be utilized when the content of the information is variable from time to time. The construction of the shown embodiment is essentially the same as the embodiment illustrated in FIG. 3 except for the service provider information storage device and the information transmission and reception control unit of the road-side unit constructed as illustrated in FIG. 11.

In the shown embodiment, a service provider A information (1102), service provider B information (1103), a service provider C information (1104) and a service provider D information (1105) are stored in a service provider information storage device 1101. To each information, a plurality of sets of information, in each of which information per se and time information indicative of effective period of the information, are contained. Namely, concerning a certain service provider, the information is set so that information 1 is effective from one timing (hour and minutes) to another timing (hour and minutes), another information is effective within another period.

On the other hand, as storage method of the information including the effective time, in addition to the method set forth above, with taking the effective time information as leading information, sets of identification of service providers and information of the service providers may also be stored. By providing effective time information per the service provider information, the effective time can be set freely per each service provider.

An information transmission and reception control unit 1106 includes a time information managing portion 1107 managing a current time, a time based information selecting portion 1108, a transmission information editing portion 1110 and a received information parsing portion 1109 in addition.

In the shown embodiment, information effective at a timing as managed by the time information managing portion 1107 is selected from the service provider information storage device 1101 by the time based information selecting portion 1108. Then, using the selected information, the transmission information editing portion 1110 performs editing process for the information to be transmitted to the vehicle.

On the other hand, when the information is transmitted from the vehicle, the received information parsing portion 1109 parses the transmitted information. The parsed result is transmitted to the transmission information editing portion 1110. In the transmission information editing portion 1110, for the information effective at that timing selected by the time based information selecting portion 1108, editing process reflecting preference depending upon the information transmitted from the vehicle is performed for transmitting the edited information to the relevant vehicle.

In the shown embodiment, concerning the service information provided from the road-side unit to the vehicle-mounted unit, by considering the effective time of the service information, the service information can be provided further effectively.

Next, a yet further embodiment of the information exchange system, to which the present invention is applicable, will be discussed with reference to FIG. 12.

In the shown embodiment, upon providing information of the service provider, a current traffic condition of the road is measured to vary the content of the service information to be provided on the basis of result of measurement.

The road-side unit in the shown embodiment includes a traffic measuring devices 1207 and 1208 for detecting number of vehicles entering into the communication regions of respective road-vehicle communication units are provided in front of respective road-vehicle communication unit, in addition to a service provider information storage device 1201, an information transmission and reception control unit 1202 and a plurality of road-vehicle communication units 1205 and 1206. Here, an information transmission and reception control unit 1302 includes a traffic based preference information editing portion 1203 controlling editing operation of the information to be transmitted or transmission state depending upon the measured traffic. On the other hand, the vehicle-mounted unit has the same construction as that explained with respect to the embodiment shown in FIG. 3.

In the shown embodiment of the information exchange system, information stored in the service provider information storage device 1201 is edited by the information transmission and reception control unit 1202 for generating the transmission information. Then, the transmission information is transmitted to the vehicle-mounted unit of each vehicle via the road-vehicle communication units 1205 and 1206. The traffic measuring devices 1207 and 1208 measure traffic amount, average speeds, traffic densities and so forth. The measured information is transmitted and stored in the traffic measurement storage device 1204. The measured information is transmitted to the traffic based preference information editing portion 1203 of the information transmission and reception control unit 1202.

By constructing the system as set forth above, providing of information in consideration of the traffic condition at that timing can be realized. Namely, the traffic based preference information editing portion 1203 performs editing process to provide higher preference for the particular information to the road-vehicle communication unit having the communication region of larger traffic amount, for example. In this case, the system has to be constructed to establish correlation between the traffic measuring devices 1207 and 1208 and the road-vehicle communication units 1205 and 1206, in advance.

On the other hand, by measuring the average speed by the traffic measuring devices 1207 and 1208, the information transmission and reception control unit 1202 may be constructed by varying the transmission amount of the information to be provided adapting to the average speed. In general, if the motion speed is low, a period, in which the vehicle is present within the particular communication region, becomes long to increase information amount which can be transmitted.

In the shown embodiment, it is possible to vary preference of the information provide or to vary communication capacity depending upon motion speed of the vehicle, information can be provided more efficiently.

Figure 12:
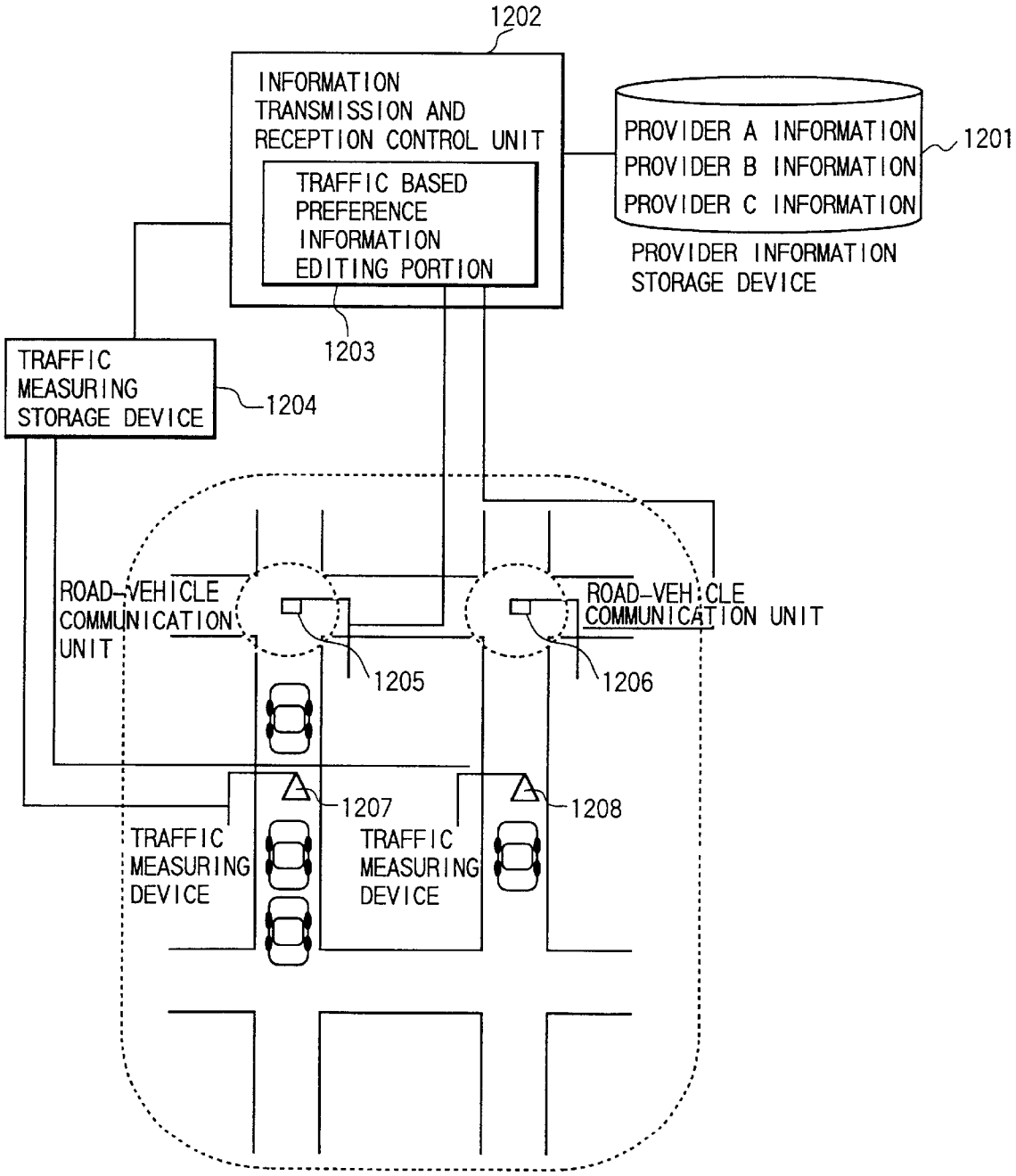
FIG. 12 is an explanatory illustration showing an embodiment of the information exchange system which varies editing preference of information to be transmitted to the vehicle using a measured traffic information.

It should be noted that, in the embodiment of FIG. 12, the motion speed of the vehicle and traffic amount are measured by the traffic measuring device to perform editing process using the result of measurement. However, it is also possible to effectively vary the information amount which can be received by the vehicle-mounted unit depending upon motion speed of the vehicle even when the traffic measuring device for actually measuring the vehicle speed is not provided. Namely, by setting the communication capacity of the road-vehicle communication unit adapting to the speed limit set for the road, the transmission capacity or the transmission method may be varied so as not to completely receive information when the vehicle travels at higher speed than the speed limit.

With the construction set forth above, the vehicle has to travel at a speed lower than or equal to the speed limit in order to appropriately receive information. By this, it can contribute for improvement of traffic safety by restricting high speed traveling.

On the other hand, in the embodiment shown in FIG. 12, information providing system utilizing the traffic information has been discussed, the present invention may also use information relating to display condition of the traffic light as means for controlling traffic of the vehicle, in place of the traffic amount.

Figure 13:
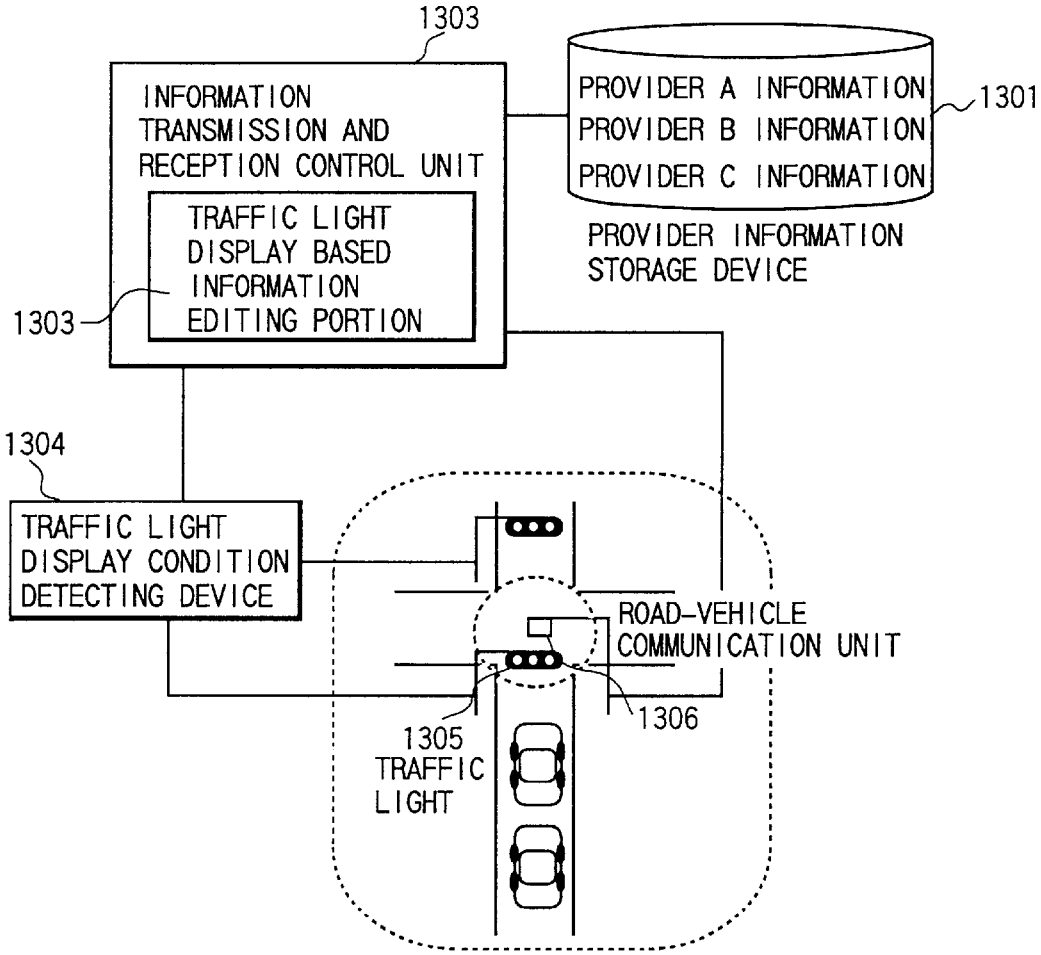
FIG. 13 is an explanatory illustration showing an embodiment of the information exchange system which varies content of information to be transmitted using a display information of a traffic light.

For example, as shown in FIG. 13, the road-side unit is provided with a traffic light condition detecting device 1304 for monitoring condition of a traffic light 1305 installed for the same lane as the road-vehicle communication unit, in addition to the service provider information storage device 1301, the information transmission and reception control unit 1302 and the road-vehicle communication unit 1306. The information transmission and reception control unit 1302 has a traffic light condition based information editing portion 1303 for editing of the information to be transmitted and controlling transmission condition, depending upon the condition of the traffic light 1305 as detected.

With such system construction, information of the traffic light 1305 installed in an intersection of the road can be made reference to the information transmission and reception control unit 1302. Therefore, information can be provided reflecting the condition of the traffic light.

For instance, for the vehicle stopping at red light, greater information can be transmitted to that to the vehicle traveling through at green light. Therefore, it is not necessary to repeatedly transmit the same information to perform communication taking that communication capacity is large. Accordingly, when the traffic light 1305 being red is detected by the traffic light condition based information editing portion 1303, the information is transmitted with taking that communication capacity is large, and otherwise, the information is transmitted taking that the communication capacity is small. On the other hand, depending upon the condition of the traffic light, detail degree or information amount of the information to be provided may be controlled.

With the system construction as illustrated in FIG. 13, as viewed from the vehicle requiring information, greater amount of information can be obtained as stopped at the red light. This indirectly effects for preventing ignoring of traffic light to contribute for improvement for safety.

Figure 14:
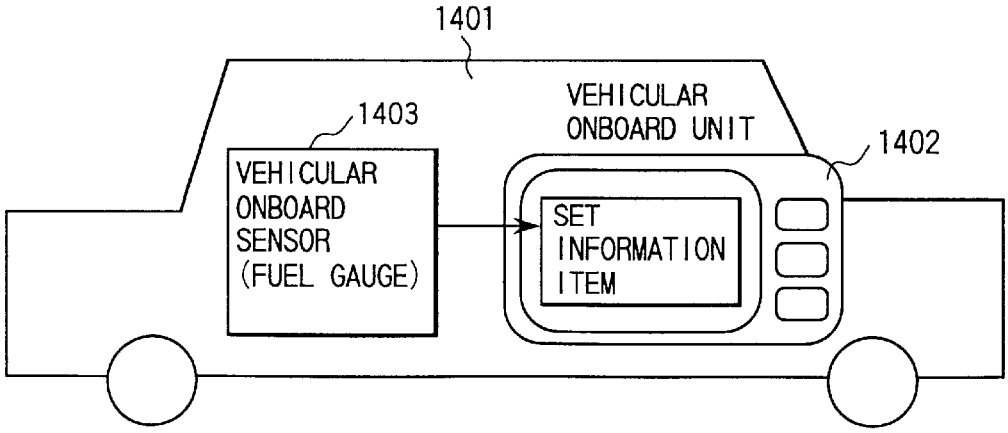
FIG. 14 is an explanatory illustration showing an embodiment of the information exchange system, in which the preference of information to be displayed on the vehicle-mounted unit is automatically varied using information of a vehicle-mounted sensor.

Next, a yet further embodiment of the information exchange system, to which the present invention is applied will be discussed with reference to FIG. 14.

In the shown embodiment, a sensor is installed on the vehicle, on which the vehicle-mounted unit is mounted. Using the information detected by the sensor, the preference of the information to be transmitted to the driver or so forth can be varied.

In the shown embodiment, on a vehicle 1401, a vehicle-mounted unit 1402 for transmitting information transmitted from the road-side unit is mounted. Also, a vehicle-mounted sensor 1403 is connected to the vehicle-mounted unit 1402. A particular example of the vehicle-mounted sensor 1403 will be a fuel gauge, an abnormality diagnosis device detecting an abnormal vibration or exhausting of battery. In this case, the vehicle-mounted unit 1402 may be constructed by adding means for setting the information item depending upon a measured information from the vehicle-mounted sensor 1403.

For example, when the fuel gauge is employed as the vehicle-mounted sensor 1403, at a timing when a remaining amount of gasoline becomes less than or equal to a predetermined value, a signal indicative of that that is transmitted to the vehicle-mounted unit 1402. The shown embodiment of the vehicle-mounted unit 1402 is responsive to the signal from the fuel gauge to automatically vary the service provider information item set by the user to set higher preference for the information item relating to the gasoline station, for example.

It should be noted that while the shown embodiment has been disclosed for the case where the fuel gauge is employed as the vehicle-mounted sensor 1403, the vehicle-mounted sensor 1403 to be employed in the present invention is not limited to this, but can be constructed employing the sensor measuring the physical amount which can be measured with respect to the vehicle, such as abnormality diagnosis device or so forth.

On the other hand, while the shown embodiment is directed to a method for varying for setting information item depending upon information from the vehicle-mounted sensor, methods for utilizing the information from the vehicle-mounted sensor in the present invention will not be limited to this. For instance, a construction is taken to effect filtering of the received information by the vehicle-mounted unit so that preference set for utilizing the information from the vehicle-mounted sensor can be reflected.

In the shown embodiment, information can be received depending upon a condition of the vehicle, and measure against abnormality of the vehicle can be taken at early timing.

While the foregoing discussion has been given for various embodiments of the present invention employing narrow range road-vehicle radio communication, the present invention is also applicable for wide range radio communication as long as sufficient communication capacity can be certainly provided.

Namely, from the communication unit covering wide range on the road side, information, in which position information and distance information are added for the service provider information stored in the service provider information storage device, is transmitted to the vehicle. On the other hand, a function corresponding to edition of information as implemented on the road side in the former embodiment, is provided in the vehicle-mounted unit on the vehicle side. Thus, among the information transmitted from the communication device on the road side, only information necessary for the driver or so forth is selected and transmitted to them.

It should be noted that when such wide range communication device is utilized, it becomes necessary to provide a so-called navigation system which detects own vehicle position by means of GPS, avroscope and so forth in the vehicle mounting the vehicle-mounted unit in order to specifically determine relative position between the service provider receiving service set and the relevant vehicle for more effectively use the service information on the basis of the determined relative position.

As set forth above, according to the present invention, it becomes possible to realize useful information exchange both for the service provider located along the road and providing services and the vehicular driver, by effectively using limited communication capacity of the road-vehicle radio communication.

Also, according to the present invention, it becomes possible to provide the information exchange system which can transmit information relating to the service provider and contents of services provided by the service provider, information edited depending upon a condition set by the vehicular driver or so forth, to the traveling vehicle, and can vary degree or level of detail or so forth of the information to be provided depending upon relative position of the service provider and the vehicle.

It should be noted that while the foregoing disclosure has been directed to an apparatus receiving information as mounted on a vehicle as a vehicle-mounted unit, the information exchange system of the present invention is not limited for mounting on the vehicle but is applicable for pocket portable apparatus carried by a person. IN this case, the vehicle-mounted unit should be a portable unit or simply an information terminal.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed:

1. An information exchange system comprising:

a vehicle-mounted unit mounted on a vehicle;

a road-side unit providing information to said vehicle-mounted unit using a road-vehicle radio communication;

said vehicle-mounted unit including receiving means for receiving information transmitted form said road-side unit through a radio communication and transferring means for transferring at least a part of a content of the received information to a vehicular occupant;

said road-side unit including storage means for storing information to be transmitted to said vehicle-mounted unit and transmitting means for transmitting information to said vehicle-mounted unit through the radio communication;

said storage means of said road-side unit for storing at least information relating to service providers of which services are available when the vehicle moves to the locations thereof; and said road-side unit further including editing means for editing information stored in said storage means on the basis of a relative position between the service providers and a communication region of said transmitting means including a distance therebetween and generating an edited information to be transmitted to the vehicle from said transmitting means.

2. An information exchange system as set forth in claim 1, wherein the information relating to the service provider stored in said storage means of said road-side unit is a plurality of information obtained with respect to a particular service provider, of which the plurality of information can be edited through editing process by said editing means.

3. An information exchange system as set forth in claim 1, wherein said storage means of said road-side unit stores at least information relating to a plurality of service providers and kinds of information for respectively specifying kinds of the plurality of service providers or kind of information thereof;

said vehicle-mounted unit further includes kind setting means for setting kinds of the service providers and kinds of information thereto to be transmitted to the vehicular occupant in response to external operation, thereby and selecting means for selecting the information transmitted from said road-side unit using the kind information and the set kind information; and said transferring means of said vehicle-mounted unit transfers the selected information to the vehicular occupant.

4. An information exchange system as set forth in claim 3, wherein said vehicle-mounted unit further includes detecting means for detecting a value representing a condition of the vehicle which mounts said vehicle-mounted unit; and said setting means modifies information to be set depending upon the detected value.

5. An information exchange system as set forth in claim 1, wherein said storage means of said road-side unit stores at least a plurality of information of different detail degrees with respect to one service provider and detail degree information for specifying the plurality of respective information of different detail degrees;

said vehicle-mounted unit further includes information detail degree setting means for setting information relating to detail degree to be transferred to the vehicular occupant in response to external operation thereby, and selecting means for selecting information transmitted from said road-side unit using the information relating to detail degree and the set detail degree when information of the set detail degree is included in the information provided from said road-side unit; and said transferring means of said vehicle-mounted unit transfers the selected information to the vehicular occupant.

6. An information exchange system as set forth in claim 1, wherein said storage means of said road-side unit stores at least a plurality of information of different detail degrees with respect to one service provider and detail degree information for specifying the plurality of respective information of different detail degrees;

said vehicle-mounted unit further includes information detail degree setting means for setting information relating to detail degree to be transferred to the vehicular occupant in response to external operation thereby, selecting means for selecting information transmitted from said road-side unit using the information relating to detail degree and the set detail degree when information of the set detail degree is included in the information provided from said road-side unit, and transmitting means which transmits information relating to the set detail degree to said road-side unit;

said transferring means of said vehicle-mounted unit transfers the selected information to the vehicular occupant; and said editing means of said road-side unit performs editing an process using the information relating to detail degree when the information relating to detail degree is contained in the information transmitted from said vehicle-mounted unit to produce information to be transmitted to said vehicle mounted unit.

7. An information exchange system as set forth in claim 1, wherein said storage means of said road-side unit further stores information relating to a plurality of service providers and information relating to contact points for radio communication with each of the service providers;

said vehicle-mounted unit further includes service provider selecting means for selecting a particular service provider among a plurality of service providers in the transmitted information, and radio communication means for performing radio communication with the selected service provider using the information relating to contact point, when the information relating to contact points is included in information transmitted from said road-side unit.

8. An information exchange system as set forth in claim 1, wherein said storage means of said road-side unit stores information relating to a plurality of service providers and information relating to relative positions between each service provider and said transmitting means including distance therebetween; and said vehicle-mounted unit further includes rearranging means for rearranging the information relating to a plurality of service providers transmitted from said road-side unit while varying a mode of transferring thereof and reflecting the relative positions thereby through controlling the operation of said transferring means when information relating to relative position is included in the information transmitted from said road-side unit.

9. An information exchange system as set forth in claim 1, wherein said vehicle-mounted unit further includes second storage means storing information, saving means for selectively saving information transmitted from said road-side unit in said second storage means, and deleting means for selectively deleting information stored in said second storage means.

10. An information exchange system as set forth in claim 1, wherein said road-side unit further includes managing means for managing information indicative of time stored in said storage means;

said storage means stores information relating to the service providers and time, at which the information becomes effective; and said editing means performs editing process using the information of the service provider based on the effective time information determined by said managing means, for generating information to be transmitted to the vehicle from said transmitting means.

11. An information exchange system as set forth in claim 1, wherein said road-side unit transmits a plurality of information relating to the service providers and information indicative of effective range in time or region to said vehicle-mounted unit; and said vehicle-mounted unit includes means for judging whether each of information transmitted falls within the effective range in time or in region or not and for deleting information judged as being out of the effective range.

12. An information exchange system as set forth in claim 1, wherein said vehicle-mounted unit further includes transmitting means which transmits information relating to type of the vehicle, and said editing, means of said road-side unit modifies the edited information depending upon the information relating to the type of the vehicle.

13. An information exchange system as set forth in claim 1, wherein said vehicle-mounted unit further includes transmitting means which transmits information relating to destination of the vehicle, and said editing means of said road-side unit modifies the edited information depending upon the information relating to the destination of the vehicle.

14. A road-side unit comprising:

storage means for storing information to be transmitted to a vehicle through a road-vehicle radio communication;

transmitting means for transmitting information to the vehicle;

said storage means storing at least information relating to service providers of which services are available when the vehicle moves to the locations thereof; and editing means for editing information stored in said storage means on the basis of a relative position between said service providers and a communication region of said transmitting means including distance therebetween and generating an edited information to be transmitted to the vehicle from said transmitting means.

15. A method of exchanging information for providing information from a side of road to a vehicle using a road-vehicle radio communication, comprising the steps of:

editing information relating to service providers of which services are available when the vehicle moves to the locations thereof on the basis of a relative positional relationship between the service providers and a region where the road-vehicle radio communication is possible including a distance therebetween, and generating information to be transmitted to the vehicle; and transmitting the edited information to the vehicle passing through the region where the road-vehicle radio communication is possible.

* * * * *